US007043191B2

(12) United States Patent
Fujii et al.

(10) Patent No.: US 7,043,191 B2
(45) Date of Patent: May 9, 2006

(54) IMAGE FORMING APPARATUS

(75) Inventors: Shuhji Fujii, Souraku-gun (JP); Kaoru Ishikura, Kyoto (JP); Takashi Imai, Nara (JP); Osamu Fujimoto, Yamatokooriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/757,677

(22) Filed: Jan. 14, 2004

(65) Prior Publication Data

US 2004/0156662 A1 Aug. 12, 2004

(30) Foreign Application Priority Data

Feb. 6, 2003 (JP) ..... 2003-030133

(51) Int. Cl.
*G03G 15/00* (2006.01)

(52) U.S. Cl. ..... 399/367; 399/376

(58) Field of Classification Search ..... 399/367, 399/369–371, 376, 377; 271/126, 127, 11
See application file for complete search history.

(56) References Cited

U.S. PATENT DOCUMENTS

| | | | | |
|---|---|---|---|---|
| 5,132,741 | A * | 7/1992 | Kitajima et al. | 399/370 |
| 5,443,252 | A * | 8/1995 | Morinaga et al. | 271/127 |
| 5,515,150 | A * | 5/1996 | Yoshie et al. | 399/367 |
| 5,552,859 | A * | 9/1996 | Nakagawa et al. | 399/23 |
| 5,610,688 | A * | 3/1997 | Inamoto et al. | 399/366 |
| 5,771,433 | A * | 6/1998 | Kimijima | 399/369 |
| 6,089,566 | A * | 7/2000 | Xu et al. | 271/265.01 |
| 6,091,927 | A * | 7/2000 | Hattori et al. | 399/367 |
| 6,266,512 | B1 * | 7/2001 | de Koning et al. | 399/370 |
| 6,601,842 | B1 * | 8/2003 | Kobayashi et al. | 271/3.14 |
| 2002/0159091 | A1 * | 10/2002 | Sakura | 358/1.15 |

FOREIGN PATENT DOCUMENTS

| | | |
|---|---|---|
| JP | 07-017640 | 1/1995 |
| JP | 10/250853 | 9/1998 |
| JP | 11-237771 | 8/1999 |

* cited by examiner

*Primary Examiner*—Anthony H. Nguyen
(74) *Attorney, Agent, or Firm*—Edwards Angell Palmer & Dodge LLP; David G. Conlin; George W. Hartnell

(57) ABSTRACT

When a document detector provided on a document tray is ON (S11: YES), a controller judges whether or not a document is of a standard size, on the basis of a document size table stored in a storing unit (S12). When the document is of a standard size (S12: YES), after a predetermined time has elapsed (S13: YES), the controller elevates/lowers the document tray on the basis of a detection output of a guide-in roller position detector and causes the document tray to wait in a state capable of supplying and conveying the topmost layer of documents immediately. An image forming apparatus thus constructed can make a judgment as to whether or not to execute supply and conveyance of documents, according to the mount state of the documents.

18 Claims, 16 Drawing Sheets

FIG. 4

| DOCUMENT TYPE | SIZE (mm) | SIZE (inch) |
|---|---|---|
| POSTCARD | 100×148 | |
| A6 | 105×148.5 | |
| A5 | 148.5×210 | |
| A4 | 210×297 | |
| A3 | 297×420 | |
| | | |
| B6 | 128.5×182 | |
| B5 | 182×257 | |
| B4 | 257×364 | |
| | | |
| INVOICE | 139.7×215.9 | 5.5×8.5 |
| LETTER | 215.9×279.4 | 8.5×11 |
| LEGAL | 215.9×355.6 | 8.5×14 |
| LEISURE | 279.4×431.8 | 11×17 |
| | | |
| USER SET | | |

IMAGE FORMING APPARATUS

This Nonprovisional application claims priority under 35 U.S.C. § 119(a) on Patent Application No.2003-030133 filed in Japan on Feb. 6, 2003, the entire contents of which are hereby incorporated by reference.

BACKGROUND OF THE INVENTION

1. Field of the Invention

The present invention relates to an image forming apparatus comprising a sheet feeder, installed in an image reading apparatus, such as a copying machine and a scanner, or in an image forming apparatus, such as a printer and a facsimile machine, for taking out sheets such as documents stored in a stacked state in sheet storing means one by one and supplying and conveying the sheets to a sheet conveyance path.

2. Description of Related Art

In recent years, a device that automatically conveys documents in the form of sheets to a reading apparatus and reads the documents one by one is installed in an image forming apparatus or the like, and efficient image reading or image forming operations are performed. Further, with the development of digital technologies, the document reading speed, the conversion speed to electronic data and the image forming speed from electronic data become faster, and the number of sheets of documents to be set at a time in such a reading apparatus is significantly increased to around 100 to 200 sheets so as to process a greater amount of documents at high speeds. In addition, with the improvement of document conveying means of the document reading apparatus, types of documents that can be conveyed is increased.

In an image reading apparatus that supplies and conveys a large amount of sets sheets such as documents and reads the images of the documents, a tray on which the sheets are mounted is kept on standby in a state capable of loading a maximum number of sheets, elevation of the tray is started when a reading start signal is inputted by a key operation or the like to start reading documents, and an operation to supply documents to a predetermined conveyance path is performed. Therefore, it takes a long time to reach a state capable of supplying the documents to the conveyance path by elevating the tray, and there is the problem of an increase in the total reading time required to complete the reading of documents.

In order to solve this problem, control is performed to automatically elevate the tray after a predetermined time has elapsed from the detection of a document mounted on the tray and complete the elevation of the tray before a reading start signal is inputted, thereby shortening the total reading time. Such an image reading apparatus is disclosed, for example, in Japanese Patent Application Laid-Open Nos. 11-237771 (1999), 10-250853 (1998) and 7-17640 (1995).

However, with the sheet feeder that automatically elevates the sheet storing unit until the topmost layer of sheets comes into contact with the sheet conveying means by simply detecting that the sheets were mounted in the sheet storing unit, the user may be confused since the elevation of the sheet storing unit may be started while a document regulating plate for regulating the document mount position is being manipulated.

Moreover, the sheet storing means may be elevated before the sheet mount position is properly regulated and the topmost layer of sheets may come into contact with the sheet conveying means, and thus troubles occur easily. In other words, if the elevation of the tray is started when setting documents on the tray, the position of the document regulating plate for aligning the document conveying position is displaced, and the set condition of documents becomes imperfect. If the documents are conveyed in the imperfectly set condition and the images are read, there arise problems of displacement or tilting of the position of the image.

BRIEF SUMMARY OF THE INVENTION

The present invention has been made with the aim of solving the above problems, and it is an object of the present invention to provide an image forming apparatus with improved working efficiency by controlling the elevation/lowering movement of sheet storing means on the basis of the position of regulating means provided for regulating the mount position of sheets, and thereby preventing sheets from being conveyed in an imperfectly stored condition.

An image forming apparatus according to the present invention comprises a sheet feeder, and image forming means for forming an image on a sheet conveyed by sheet conveying means. The sheet feeder comprises: sheet storing means for storing a plurality of sheets layered one upon another; elevation/lowering driving means for elevating/lowering the sheet storing means; and sheet conveying means for taking out sheets one by one from a topmost layer that is brought into contact with the sheet conveying means by elevating the sheet storing means with the elevation/lowering driving means and conveying the sheets to a predetermined conveyance path, and is characterized by further comprising: regulating means, mounted slidably with respect to the sheet storing means, for regulating a mount position of sheets; position detecting means for detecting a position of the regulating means; and control means for controlling an elevation/lowering movement of the sheet storing means caused by the elevation/lowering driving means on the basis of a detection result of the position detecting means.

In the present invention, based on the position of the regulating means which is mounted slidably with respect to the sheet storing means to regulate the mount position of sheets, the sheet storing means is controlled to be elevated/lowered. Accordingly, when the detected position of the regulating means is a predetermined position, it is possible to control the sheet storing means to be elevated so that the topmost layer of the stored sheets comes into contact with the sheet conveying means, or, when the detected position of the regulating means is not the predetermined position, it is possible to control the sheet storing means to be on standby so that the topmost layer of the sheets does not come into contact with the sheet conveying means, or to control the sheet storing means to be elevated after a predetermined time has elapsed. Thus, since the operation of the sheet storing means can be controlled according to the position of the regulating means for regulating the mount position of sheets, it is possible to prevent problems such as conveyance of sheets in a tilted condition due to the imperfectly regulated mount position of sheets and formation of images in this condition.

The image forming apparatus according to the present invention may further comprise: storing means for storing one or a plurality of types of sheet information; measuring means for measuring dimensions of a sheet stored in the sheet storing means on the basis of a detection result of the position detecting means; and judging means for judging whether or not the sheet corresponds to the sheet information stored in the storing means, on the basis of the dimensions measured by the measuring means. In this configuration, when the judging means judges that the sheet corresponds to the sheet information, the control means controls the elevation/lowering driving means to elevate the sheet storing means.

In the present invention, the dimensions of a stored sheet are measured on the basis of the position of the regulating means, and a judgment is made as to whether or not the sheet is a type of sheet pre-stored in the storing means, on the basis of the measurement result. Then, when it is judged that the sheet is a pre-stored type of sheet, the sheet storing means is elevated. Therefore, when the measured dimensions of the sheet show values corresponding to the pre-stored sheet information, it is judged that the sheet is set properly, and the sheet storing means is elevated to cause the topmost layer of the sheets to come into contact with the sheet conveying means. On the other hand, when the measured dimensions of the sheet do not correspond to the stored sheet information, the sheet storing means is kept on standby so as not to cause the topmost layer of the sheets to come into contact with the sheet conveying means, or elevated after a predetermined time has elapsed. With such control, it is possible to prevent the sheets from being conveyed to the sheet conveying means in an imperfectly stored condition, i.e., in a tilted condition, thereby avoiding troubles. Moreover, it is possible to provide sufficient time to perform the operation of correcting the set condition of sheets.

The image forming apparatus according to the present invention may further comprise timer means. In this configuration, when the judging means judges that the sheet corresponds to the sheet information, the control means controls the elevation/lowering driving means to elevate the sheet storing means after a predetermined time has elapsed from a time at which the judging means made the judgment. On the other hand, when the judging means judges that the sheet does not correspond to the sheet information, the control means stops control of the elevation/lowering driving means.

In the present invention, when the measured dimensions of the sheet correspond to the sheet information stored in the storing means, it is judged that the sheet is set properly, and the sheet storing means is elevated, or, when the measured dimensions of the sheet do not correspond to the sheet information stored in the storing means, it is judged that the sheet is not set properly and the sheet storing means is not moved. Therefore, the sheets will never be conveyed to the sheet conveying means in an imperfectly stored condition, i.e., in a tilted condition, thereby avoiding troubles. Moreover, it is possible to provide sufficient time to perform the operation of correcting the set condition of sheets.

The image forming apparatus according to the present invention may further comprise timer means. In this configuration, when the judging means judges that the sheet corresponds to the sheet information, the control means controls the elevation/lowering driving means to elevate the sheet storing means after a first predetermined time has elapsed from a time at which the judging means made the judgment. On the other hand, when the judging means judges that the sheet does not correspond to the sheet information, the control means controls the elevation/lowering driving means to elevate the sheet storing means after a second predetermined time has elapsed from a time at which the judging means made the judgment.

In the present invention, when the measured dimensions of the sheet correspond to the sheet information stored in the storing means, the sheet storing means is elevated after the elapse of the first predetermined time, or, when the measured dimensions of the sheet do not correspond to the sheet information stored in the storing means, the sheet storing means is elevated after the elapse of the second predetermined time. Therefore, by setting the second predetermined time longer than the first predetermined time, it is possible to delay the elevation movement of the sheet when the measured dimensions of the sheet do not correspond to the sheet information stored in the storing means. Consequently, even when sheets which are not of preset dimensions are stored, it is possible to provide sufficient time to set the sheets in the sheet storing means, thereby preventing the sheets from being conveyed to the sheet conveying means in an imperfectly stored condition.

The image forming apparatus according to the present invention may further comprise sheet detecting means for detecting whether or not a sheet is mounted in the sheet storing means. In this configuration, when the sheet detecting means detects a sheet stored in the sheet storing means and the judging means judges that the sheet corresponds to the sheet information, the control means controls the elevation/lowering driving means to elevate the sheet storing means after a predetermined time has elapsed. On the other hand, when the sheet detecting means detects a sheet stored in the sheet storing means and the judging means judges that the sheet does not correspond to the sheet information, control of the elevation/lowering driving means by the control means is stopped.

In the present invention, only when a sheet is properly mounted and the mount position of the sheet is properly regulated, the sheet storing means is elevated after the elapse of the predetermined time. Accordingly, during setting of a sheet in the sheet storing means, or when a sheet is not set properly, the elevation of the sheet storing means is not performed, and therefore the user can spend sufficient time for mounting the sheet and regulating the mount position of the sheet.

The image forming apparatus according to the present invention may further comprise sheet detecting means for detecting whether or not a sheet is mounted in the sheet storing means. In this configuration, when the sheet detecting means detects a sheet stored in the sheet storing means and the judging means judges that the sheet corresponds to the sheet information, the control means controls the elevation/lowering driving means to elevate the sheet storing means after a first predetermined time has elapsed. On the other hand, when the sheet detecting means detects a sheet stored in the sheet storing means and the judging means judges that the sheet does not correspond to the sheet information, the control means controls the elevation/lowering driving means to elevate the sheet storing means after a second predetermined time has elapsed.

In the present invention, when a sheet is properly mounted and the mount position of the sheet is properly regulated, the sheet storing means is elevated after the elapse of the first predetermined time, whereas, when the mount position of the sheet is not properly regulated, the sheet storing means is elevated after the elapse of the second predetermined time. Accordingly, during setting of a sheet in the sheet storing means, or when a sheet is not set properly, it is possible to delay the elevation of the sheet storing means, and therefore the user can spend sufficient time for mounting the sheet and regulating the mount position of the sheet.

The image forming apparatus according to the present invention may further comprise contact detecting means for detecting a contact state between the topmost layer of the sheets stored in the sheet storing means and the sheet conveying means. In this configuration, the control means controls the elevation/lowering driving means to elevate the sheet storing means until the contact detecting means detects the contact state.

In the present invention, since the sheet storing means is elevated until the topmost layer of the sheets and the sheet conveying means come into contact with each other, the sheets can be conveyed by the sheet conveying means after the sheets are properly stored.

In the image forming apparatus according to the present invention, the control means may control the elevation/lowering driving means, after the second predetermined time has elapsed, to elevate the sheet storing means to a predetermined position where the topmost layer of the sheets and the sheet conveying means are separated.

In the present invention, during elevation of the sheet storing means after the elapse of the second predetermined time, control is performed so as not to cause the topmost layer of the sheets and the sheet conveying means to come into contact with each other. Therefore, the regulating means can be easily manipulated even after the sheet storing means is elevated, and the sheets will never be conveyed to the sheet conveying means in an imperfectly stored condition.

The above and further objects and features of the invention will more fully be apparent from the following detailed description with accompanying drawings.

BRIEF DESCRIPTION OF THE SEVERAL VIEWS OF THE DRAWINGS

FIG. 4 is a schematic view showing one example of a document size table that stores types of sheets to be supplied and conveyed to the image reading apparatus;

DETAILED DESCRIPTION OF THE INVENTION

The following description will explain the present invention in detail on the basis of the drawings illustrating some embodiments thereof.

First Embodiment

Figure 1:
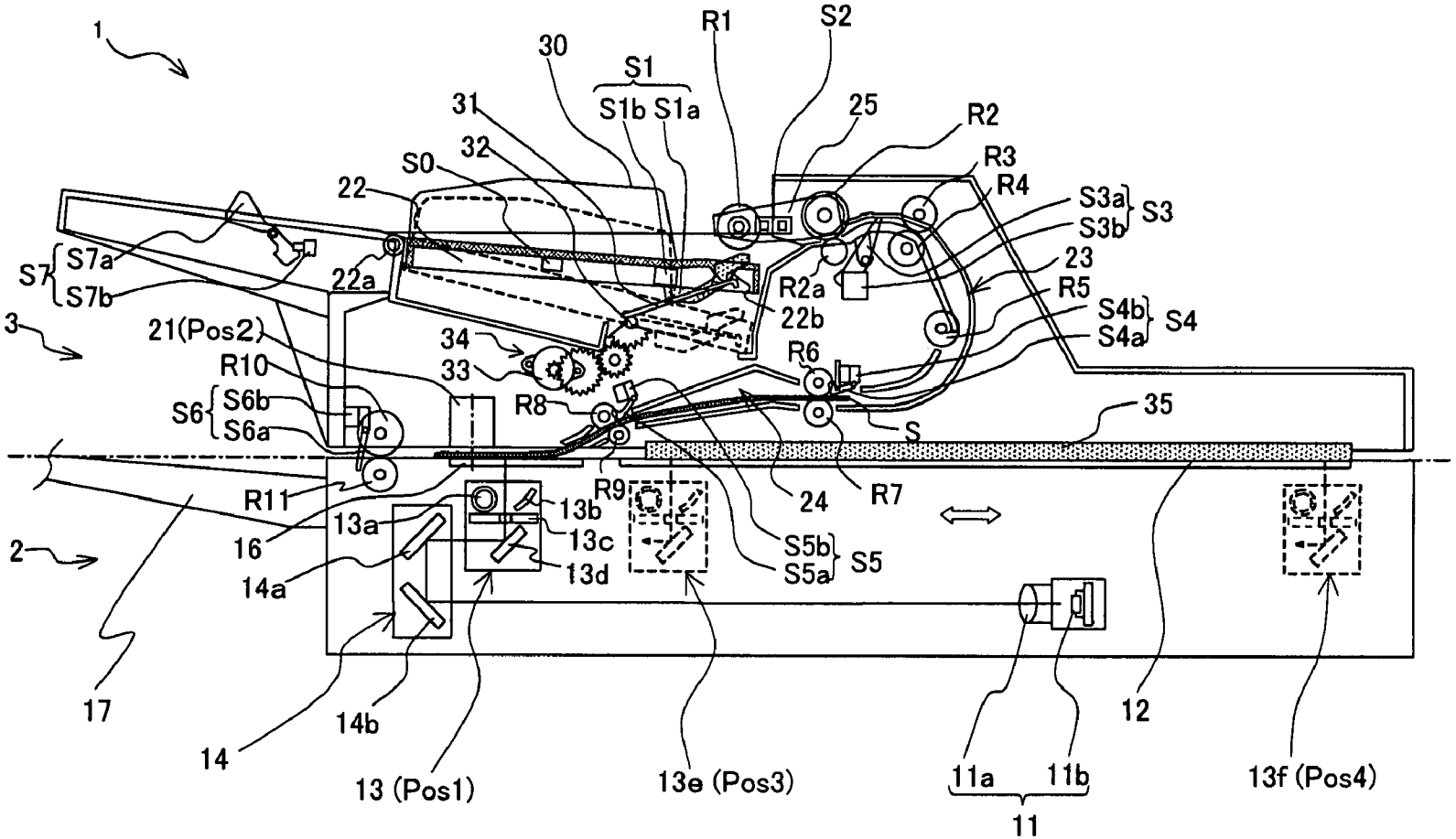
FIG. 1 is a vertical cross sectional view showing the entire configuration of an image reading apparatus according to an embodiment of the present invention.

FIG. 1 is a vertical cross sectional view showing the entire configuration of an image reading apparatus according to this embodiment. In FIG. 1, numeral 1 represents an image reading apparatus which is composed roughly of an optical system 2 and an ADF (Automatic Document Feeder) 3 disposed above the optical system 2, and is used as a scanner device capable of reading images formed on both surfaces of a document.

The optical system 2 comprises a CCD reading unit (CCD: Charge Coupled Device) 11 serving as a first reading unit; a light source unit 13; and a mirror unit 14. By using the light source unit 13 and the mirror unit 14, the optical system 2 causes the CCD reading unit 11 disposed in a predetermined position to read the image of a document that is mounted on a document table 12 made of a platen glass and is supported in a flat state. The CCD reading unit 11 comprises an imaging lens 11*a* and a CCD 11*b*, and focuses reflected light from the document, which has passed through later-described respective sections, onto the CCD 11*b* through the imaging lens 11*a*.

The light source unit 13 comprises a light source 13*a*; a concave reflector 13*b* for condensing illumination light, irradiated from the light source 13*a* for reading, onto a predetermined reading position on the document table 12; a slit 13*c* for passing only the reflected light from the document; and a mirror 13*d* with a reflecting surface arranged at 45° with respect to the surface of the document table 12 so as to change the optical path of light passed through the slit 13*c* by 90°.

The mirror unit 14 is composed of a pair of mirrors 14*a* and 14*b* with reflecting surfaces arranged orthogonally to further change, by 180°, the optical path of light whose optical path was changed by 90° by the mirror 13*d* of the light source unit 13.

As indicated by reference codes 13*e* and 13*f*, by moving the light source unit 13 in the direction of open arrows in the figure (a sub-scanning direction) parallel to the surface of the document table 12 and moving the mirror unit 14 in the direction of open arrows similarly, the image of a document mounted on the document table 12 can be read. At this time, it is necessary to adjust the moving speed of the mirror unit 14 to be a half of the moving speed of the light source unit 13. These light source unit 13 and mirror unit 14 are moved by a stepping motor (see FIG. 2).

Note that the CCD reading unit 11 may be designed to focus reflected light produced by reflecting the light irradiated from the light source 13*a* by the document onto the CCD 11*b* through the imaging leans 11*a* while scanning in the sub-scanning direction a unit of reduced reading optical system (or equal-magnification reading optical system) that is produced by constructing at least the imaging lens 11*a*, the CCD 11*b* and the light source 13*a* as one unit.

Moreover, this optical system 2 comprises another document table 16 in a position separated from the document table 12 in the sub-scanning direction. The light source unit 13 can read the image on one surface (hereinafter referred to as the front surface) of the document conveyed on the document table 16, in a state in which the light source unit 13 is stationary under the document table 16. A sheet discharge tray 17 is provided near the exit of the document conveyed on the document table 16.

On the other hand, the ADF 3 comprises a CIS (Contact Image Sensor) 21 serving as a second reading unit at a position facing the document table 16. The ADF 3 picks up one sheet of document at a time from the documents mounted in a stacked state on a document tray 22, and causes the CIS 21 to read the image on the other surface (hereinafter referred to as the rear surface) of the document. Therefore, the ADF 3 further comprises various rollers R1 through R10, detectors S1 through S7, a curved conveyance path 23, and a resist/skew correction area 24.

Note that the CIS 21 comprises an image sensor arranged in an array, for example, light guiding means (a lens array such as a SELFOC lens), and a light source (an LED array light source or a fluorescent lamp).

Figure 2:
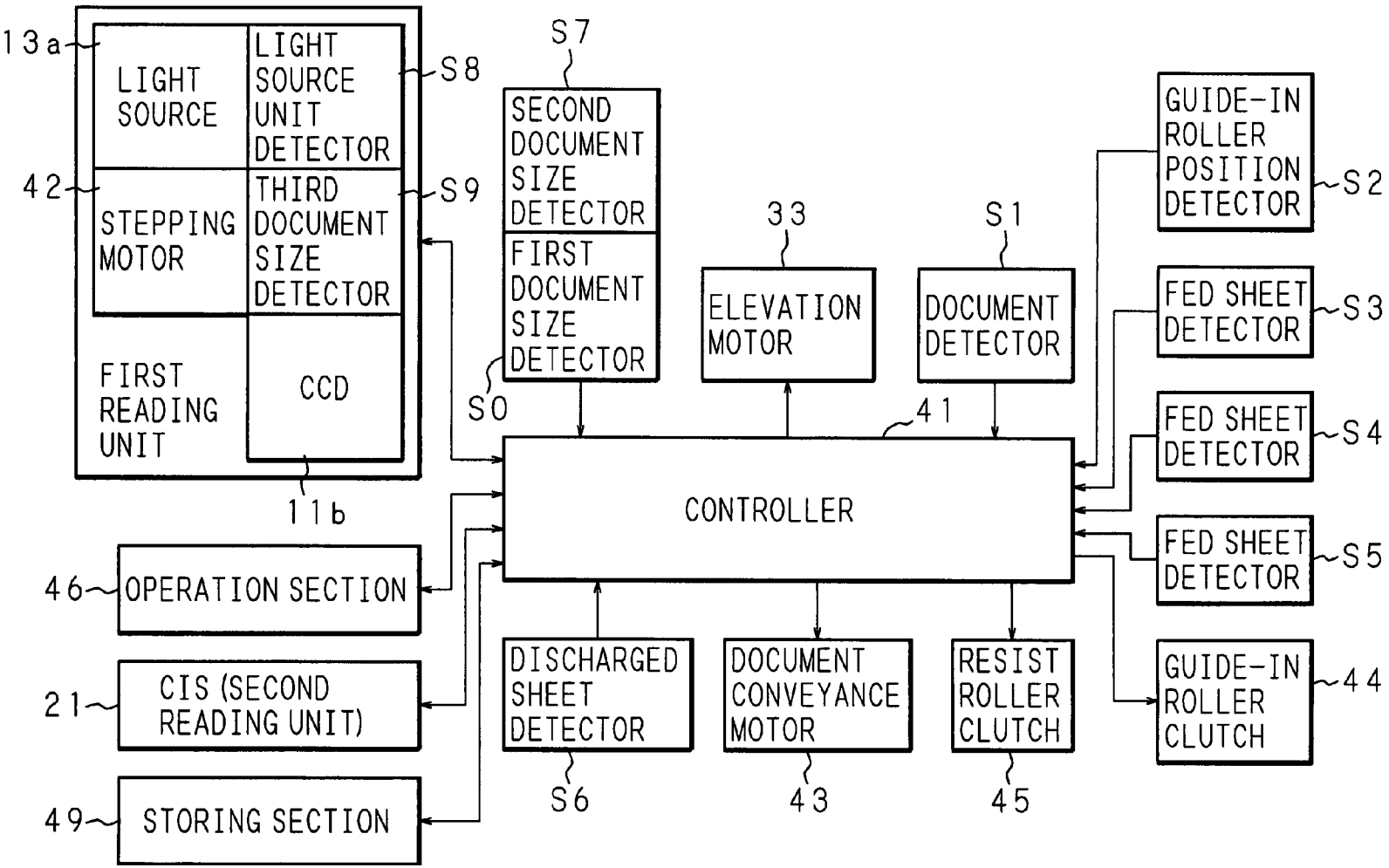
FIG. 2 is a block diagram showing the functional structures of an image reading apparatus according to an embodiment of the present invention.

Note that the various rollers R1 through R10 are driven by a document conveyance motor (see FIG. 2). Further, although it is described in detail later, a guide-in roller clutch (see FIG. 2) is connected to the guide-in roller R1 and the separating roller R2 that are connected with transmission means such as a belt, and a resist roller clutch (see FIG. 2) is connected to either of the resist rollers R8 and R9. By connecting or disconnecting these clutches under the control of a later-described controller (see FIG. 2), the driving force of the document conveyance motor is transmitted to the guide-in roller R1, separating roller R2 and resist rollers R8 and R9, or cut off.

The document tray 22 is an electric tray. When the optical document detector S1 composed of an actuator S1*a* and a sensor body S1*b* detects that documents were set, the document tray 22 starts to be elevated at a predetermined timing and the topmost layer of the stack of documents mounted pushes up the guide-in roller R1. This guide-in roller R1 is supported by an arm 25 so that it is freely elevated/lowered and displaced. When the guide-in roller position detector S2 detects a displacement of the guide-in roller R1, specifically detects that the guide-in roller R1 was pushed up, the document tray 22 stops elevating temporarily and is kept on standby in this state.

Note that, after the documents are set on the document tray 22 and the document tray 22 is put into the standby state as described above, if the document tray 22 is left idle for a predetermined time without inputting a signal for starting reading, the document tray 22 may continue to be kept on standby in this state, but it is preferable to lower the document tray 22 to a predetermined height position temporarily and keep it in the standby state so as to prevent deformation of the guide-in roller R1.

Then, when a start signal to feed documents is inputted, the guide-in roller R1 and the separating roller R2 are driven and rotated to pick up the documents one by one from the topmost layer of the stack of documents. The separating rollers R2 and R2*a* are positioned on the downstream side of the guide-in roller R1. The guide-in roller R1 is supported by the arm 25, and the arm 25 is supported movably around the rotation shaft of the separating roller R2. In addition, the guide-in roller R1 is designed to come into contact with the topmost layer of documents set on the document tray 22 by its own weight. Besides, a stopper (not shown) is provided so as not to lower the guide-in roller R1 by an amount more than a necessary amount. As described later, the arm 25 has a protruding section, and the guide-in roller position detector S2 composed of an optical sensor and the like can detect the height of the guide-in roller R1 from the swing angle of the arm 25.

Note that in this embodiment, the guide-in roller position detector S2 is mounted by providing the protruding section on the arm 25, and the height position of the guide-in roller R1 is directly detected by this guide-in roller position detector S2, but the guide-in roller position detector S2 may be mounted at a position separated from the arm 25. In this case, movable connecting means may be used to detect the height position of the arm 25.

The separating roller R2 is positioned to face the separating roller R2*a* (a friction pad may be used instead) having a torque limiter. Therefore, even when plural sheets of documents are picked up by the guide-in roller R1, only the topmost layer of documents adhering to the guide-in roller R1 is picked up by the separating rollers R2 and R2*a*, and thus the documents are surely separated and conveyed one sheet at a time without feeding the documents in an overlapped state.

Note that whether or not a document was certainly separated and supplied by the separating rollers R2 and R2*a* is detected by the fed sheet detector S3 composed of an actuator S3*a* and a sensor body S3*b*. Then, the document is conveyed at a predetermined timing to the curved conveyance path 23 on the downstream side.

In the curved conveyance path 23, the document is conveyed by the conveyance rollers R3 through R7, and whether the document is conveyed forcibly or not is detected by the fed sheet detector S4 composed of an actuator S4*a* and a sensor body S4*b* for detecting the discharge of the document from the curved conveyance path 23. The curved conveyance path 23 has a curvature capable of conveying any kind of document in a stable manner, and is constructed with a curvature capable of smoothly conveying the thickest document, i.e., the sturdiest document, among readable documents.

The document discharged from the curved conveyance path 23 is conveyed to the resist/skew correction area 24. When the leading end of the document is detected by the fed sheet detector S5 positioned in front of the resist rollers R8 and R9 near the exit of the resist/skew correction area 24, the leading end of the document is caused to collide with the joint of the resist rollers R8 and R9 by a conveyance force from the upstream side over a predetermined time in a state in which the resist rollers R8 and R9 are stopped, and a resist and skew correction is performed. The fed sheet detector S5 is composed of an actuator S5*a* and a sensor body S5*b*.

The resist/skew correction area 24 is designed so that a document S is in a substantially straightened condition between the conveyance rollers R6 and R7 and the resist rollers R8 and R9 and is free as much as possible from the guide surface of the conveyance path so as to allow the above-mentioned resist/skew correction of document to be performed in the resist/skew correction area 24 ranging from the transport rollers R6 and R7 positioned on the downstream side of the curved conveyance path 23 to the resist rollers R8 and R9. Note that the distance between the conveyance rollers R6 and R7 and the resist rollers R8 and R9 may be set by ensuring at least the length of the smallest document, in the conveying direction, among documents that can be handled by the document feeder. In other words, the shorter the trailing end portion of the document remaining in the curved conveyance path 23, the smoother the resist/skew correction of document is performed.

The conveyance of the document, for which the resist/skew correction was made in the resist/screw correction area 24, is resumed at a predetermined timing, and the document is conveyed to a first reading position Pos1 for exposing and scanning the front surface of the document. Further, the document passes through a second reading position Pos2 for exposing and scanning the rear surface of the document. The light source unit 13 faces the first reading position Pos1, and the CIS 21 faces the second reading position Pos2.

The document whose image on the front surface or images on both the front and rear surfaces were thus read is discharged onto the sheet discharge tray 17, which is supported on a side surface of the image reading apparatus 1 located in a lower position than the document discharge point, by the discharge rollers R10 and R11 (the discharge roller R11 being positioned on the optical system 2 side). The confirmation of this document discharge operation is detected by the discharged sheet detector S6 composed of an actuator S6*a* and a sensor body S6*b*.

The above-described operations are repeated one after another until all the documents set on the document tray 22 are fed, and all the documents which have been read are discharged one by one onto the sheet discharge tray 17.

By the way, since the height of the stack of documents is lowered when the documents are fed one by one, the document tray 22 is controlled to be elevated by an amount corresponding to the lowering of the position of the guide-in roller R1 so as to always keep a predetermined height relationship between the topmost layer of the stack of documents and the guide-in roller R1. Therefore, the document tray 22 can swing on a fulcrum 22*a*, and a rib 22*b* provided on the opposite end to the fulcrum 22*a* can be elevated by pushing it up by an elevation/lowering plate 31, but the rib 22*b* is lowered when the elevation/lowering plate 31 is lowered. An end of the elevation/lowering plate 31 opposite to the rib 22*b* is fixed to a plate supporting shaft 32, and the plate supporting shaft 32 is driven and rotated by an elevation/lowering motor 33 through an elevation/lowering mechanism section 34 composed of a transmission member (gear) train.

The position of this document tray 22 during standby is maintained by driving and controlling the elevation/lowering motor 33 of the elevation/lowering mechanism section 34 by the later-described controller (see FIG. 2) on the basis of a detection signal of the guide-in roller position detector S2. The position of the document tray 22 during standby can be set arbitrarily by a later-described operation section (see FIG. 2) according to a frequently set number of documents on the document tray 22 in an ordinary general use condition, and can be set suitably by a service person or a user.

Further, the document tray 22 can be elevated/lowered and displaced within a range between the height position of the entrance side and the height position of the exit side of the curved conveyance path 23, which are inevitably formed by the curved conveyance path 23 that was set to guarantee stable conveyance of documents as described above. When the document tray 22 is moved in the lowering direction within this range, the interval between the document tray 22 and the guide-in roller R1 increases, and therefore a large amount of documents can be mounted and fed one by one by elevating the topmost layer of the large amount of documents mounted on the document tray 22 to a state capable of being fed to the entrance of the curved conveyance path 23.

Moreover, the document tray 22 has the document regulating plate 30 for regulating the mount position of documents by aligning the sides of the documents, and the position of this document regulating plate 30 is detected by the first document size detector S0 for detecting the width of the document (the length in a direction orthogonal to the document feed direction). Note that the document tray 22 is also provided with the second document size detector S7 composed of an actuator S7*a* and a sensor body S7*b* for detecting the length of the document (the length in the document feed direction). The size of a document mounted on the document tray 22 is detected by these first and second document size detectors S0 and S7, and a sheet for image formation is selected on the basis of the detection results, and the detection results are also used by the later-described controller for the control of the height position of the document tray 22.

In the meantime, when reading a document on the document table 12, the light source unit 13 is moved from a position Pos3 (the start position of the light source unit 13 when reading a stationary position) toward a position Pos4 (the return position of the light source unit 13 when reading the largest document) in FIG. 1 by only a predetermined distance according to a document size detected by a third document size detector (see FIG. 2) for detecting the size of a document mounted on the document table 12.

On the other hand, when reading the conveyed document, the light source unit 13 is stopped at the first reading position Pos1 (the position of the light source unit 13 when reading a moving document). Moreover, the light source unit 13 uses either a position between the position Pos3 and the position Pos4, or a position between the position Pos3 and the first reading position Pos1, as a home position based on the detection result of a light source unit detector (see FIG. 2) serving as the position detector of the light source unit 13. Therefore, when the light source unit 13 is not in use, i.e., is on standby, it is stopped in this home position.

Here, in order to read the document mounted on the document table 12, a portion of the ADF 3 located on the back side of the image reading apparatus 1 (the back side of the paper face) is movably supported by a hinge (not shown) attached between the ADF 3 and the optical system 2. The ADF 3 moves around this hinge as a movement support and opens upward with respect to the document tray 12. In other words, by opening the ADF 3 by moving it upward, the top surface of the document table 12 of the image reading apparatus 1 can be released from the front side on FIG. 1, and consequently documents of types that can not be conveyed by the ADF 3 because they are not in a sheet form, for example, a book material and a bound document, can be set on the document table 12.

Note that a document mat 35 formed of an elastic material is provided on the bottom surface of the ADF 3, i.e., the surface facing the document table 12.

The image reading apparatus 1 thus constructed can read documents in three modes, namely, a stationary read mode, a moving read mode, and a double-side read mode. The stationary read mode is a mode in which the light source unit 13 and the mirror unit 14 are scanned and the image of a document such as a book material mounted on the document table 12 is read by the CCD reading unit 11. The moving read mode and the double-side read mode are modes in which the images of documents set on the document tray 22 are read by automatically feeding one sheet at a time by the ADF 3. In the moving read mode, the documents are read by the CCD reading unit 11, whereas, in the double-side read mode, the images of documents are read using both of the CCD reading unit 11 and the CIS 21.

Note that in this embodiment, the maximum number of documents that can be set on the document tray 22 is around 200 sheets if the documents have a thickness of, for example, an ordinary copy sheet or so.

FIG. 2 is a block diagram showing the functional structures of the image reading apparatus 1 according to this embodiment. In FIG. 2, the structures same as or corresponding to those shown in FIG. 1 are designated with the same reference codes, and the explanation thereof is omitted.

The image reading apparatus 1 comprises a controller 41 composed of a microcomputer, etc., and performs various control operations. The detection results of the first and second document size detectors S0 and S7 for detecting the size of the document set on the document tray 22 and the detection result of the third document size detector S9 for detecting the size of the document set on the document table 12 are supplied to the controller 41, and the controller 41 switches control of the sheet to be used and timing, on the basis of the detection results of these document size detectors S0, S7 and S9.

In the reading of the document using the CCD reading unit 11, the controller 41 drives and controls the stepping motor 42 to move the light source unit 13 and the mirror unit 14 as described above, and controls the light source 13*a* and the CCD 11*b* according to the position of the light source unit 13 detected by the light source unit detector S8 so as to read the image of the document.

On the other hand, in the reading of the document using the ADF 3, the controller 41 drives and controls the elevation/lowering motor 33 on the basis of the detection result of the guide-in roller position detector S2; keeps the topmost layer of a stack of documents set on the document tray 22 at a fixed height; conveys the documents by controlling the document conveyance motor 43, the guide-in roller clutch 44 of the guide-in roller R1 and the resist roller clutch 45 of the resist rollers R8 and R9 until the document detector S1 detects that all the documents on the document tray 22 have been fed; and reads the images of the documents by controlling the CCD 11*b* and the CIS 21.

Moreover, the controller 41 displays necessary information on the operation section 46 composed of a liquid crystal touch panel, etc., and receives an input operation applied to the operation section 46.

Further, a storing section 49 such as a memory is connected to the controller 41, and a document size table storing document sizes that can be mounted on the document tray 22 is stored as sheet information in a part of the storing area.

In the image reading apparatus 1 of this embodiment, the topmost layer of a stack of documents mounted on the document tray 22 is in contact with the guide-in roller R1 in a standby state and is in a state capable of feeding the document immediately. In this state, when the first document size detector S0 detects that the document regulating plate 30 was manipulated, the controller 41 judges that a document is to be added, drives and controls the elevation/lowering motor 33 to lower the document tray 22, and cancels the contact between the guide-in roller R1 and the stack of documents.

The lowering amount when lowering the document tray 22 may be values preset during the manufacture or shipment of the image reading apparatus 1, or values arbitrarily set by the service person or the user from the operation section 46, according to a frequently set number of documents on the document tray 22 in an ordinary general use condition.

Figure 3:
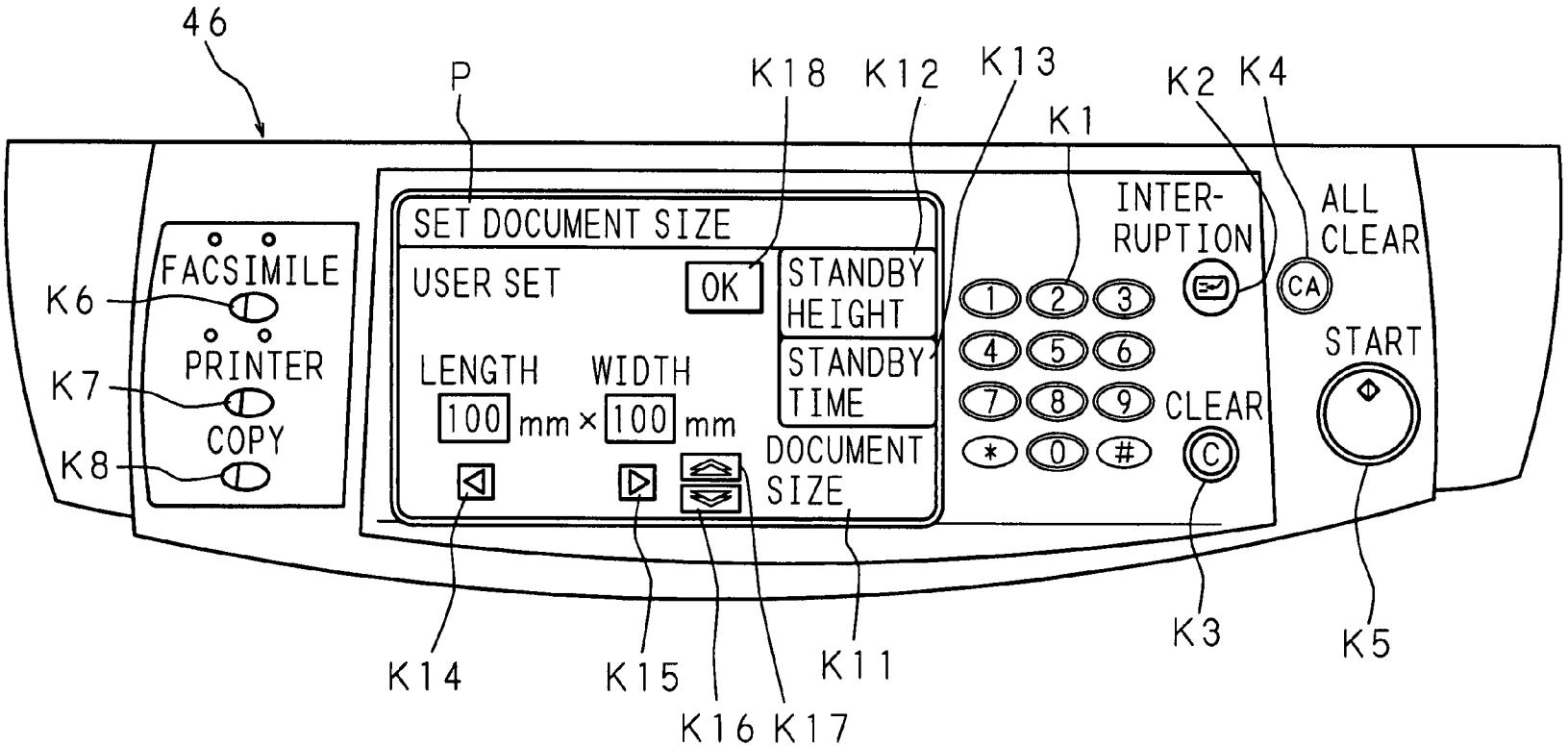
FIG. 3 is a schematic view showing an example of the structure of an operation section of the image reading apparatus.

FIG. 3 is a schematic view showing an example of the structure of the operation section 46 of the image reading apparatus 1. Although not shown in FIG. 1, the operation section 46 is positioned on the top surface of the image reading apparatus 1, and comprises various hardware keys (K1 through K8) and an operator control panel P composed of a liquid crystal touch panel.

The various hardware keys (K1 through K8) provided in the operation section 46 include K1 as a ten-key keypad for inputting numbers, K2 as an Interruption key, K3 as a Clear key, K4 as an All Clear (all delete) key, K5 as a Start key for starting to read a document, and K6, K7 and K8 as function switching keys for selecting a facsimile function, a printer function and a copy function, respectively.

Note that since the image reading apparatus 1 of this embodiment does not have facsimile communication means for transmitting and receiving facsimile data to/from an external facsimile machine and image forming means for forming an image on a sheet, it does not necessarily have the function switching keys K6 through K8. However, since the image reading apparatus 1 is sometimes connected as an additional device to an image forming apparatus comprising facsimile communication means and image forming means, it may be provided with these function switching keys K6 through K8 in advance.

The operator control panel P has various software keys. In the operator control panel P, K11 through K13 represent software keys for displaying a setting screen for setting a document size, a setting screen about the standby time, and a setting screen about the standby height, respectively.

In the setting screen for setting a document size, the user can arbitrarily set a document size other than standard sizes. In the setting screen about the standby time of the document tray 22, it is possible to set a standby time before starting to elevate the document tray 22 after completion of manipulation of the document regulating plate 30. In the setting screen about the standby height of the document tray 22, it is possible to set a default height (standby height) of the document tray 22.

In the example illustrated in FIG. 3, the setting screen about the document size is shown, and selection keys K14 and K15, size setting keys K16 and K17, and Enter key K18 are displayed on the operator control panel P. The selection keys K14 and K15 are used when selecting the length or width of a document, and the size setting keys K16 and K17 are used to input the size (width or length) of a document.

When the Enter key K19 in the operator control panel P is pressed, the document size set in this setting screen is stored in the document size table (see FIG. 4) that is stored as sheet information in the storing section 49. The stored document size is read by the controller 41 when the user sets a document on the document tray 22, and it is detected whether or not the document has a predetermined size.

FIG. 4 is a schematic view showing one example of the document size table that stores types of sheets to be supplied and conveyed to the image reading apparatus 1. As shown in FIG. 4, in the document size table, the sizes of documents are stored in millimeter unit or inch unit in association with the types of the documents. As the sizes pre-stored in the document size table, there are values of standard sizes such as a postcard, A-print-size sheets, B-print-size sheets, invoice, letter, legal and leisure. Note that in this embodiment, the slide position of the document regulating plate 30 is detected and then it is judged whether or not the mounted document has a predetermined size, on the basis of the detection value (specifically, the resistance of a later-described resistor). Therefore the detection value may be stored in association with each size in the document size table in addition to the document type and the document size. Moreover, a conversion table for converting the detection value into a length unit may be prepared in addition to the document size table, and it may be judged whether or not a mounted document has a predetermined size, with reference to both the tables.

Besides, as described above, the user can arbitrarily set a document size to be used on the operator control panel P of the operation section 46, and the set value is stored in a user set column of the document size table. Note that, when the controller 41 detects the document size, the set value stored in the user set column is treated without being distinguished from the values of standard sizes.

Figure 5:
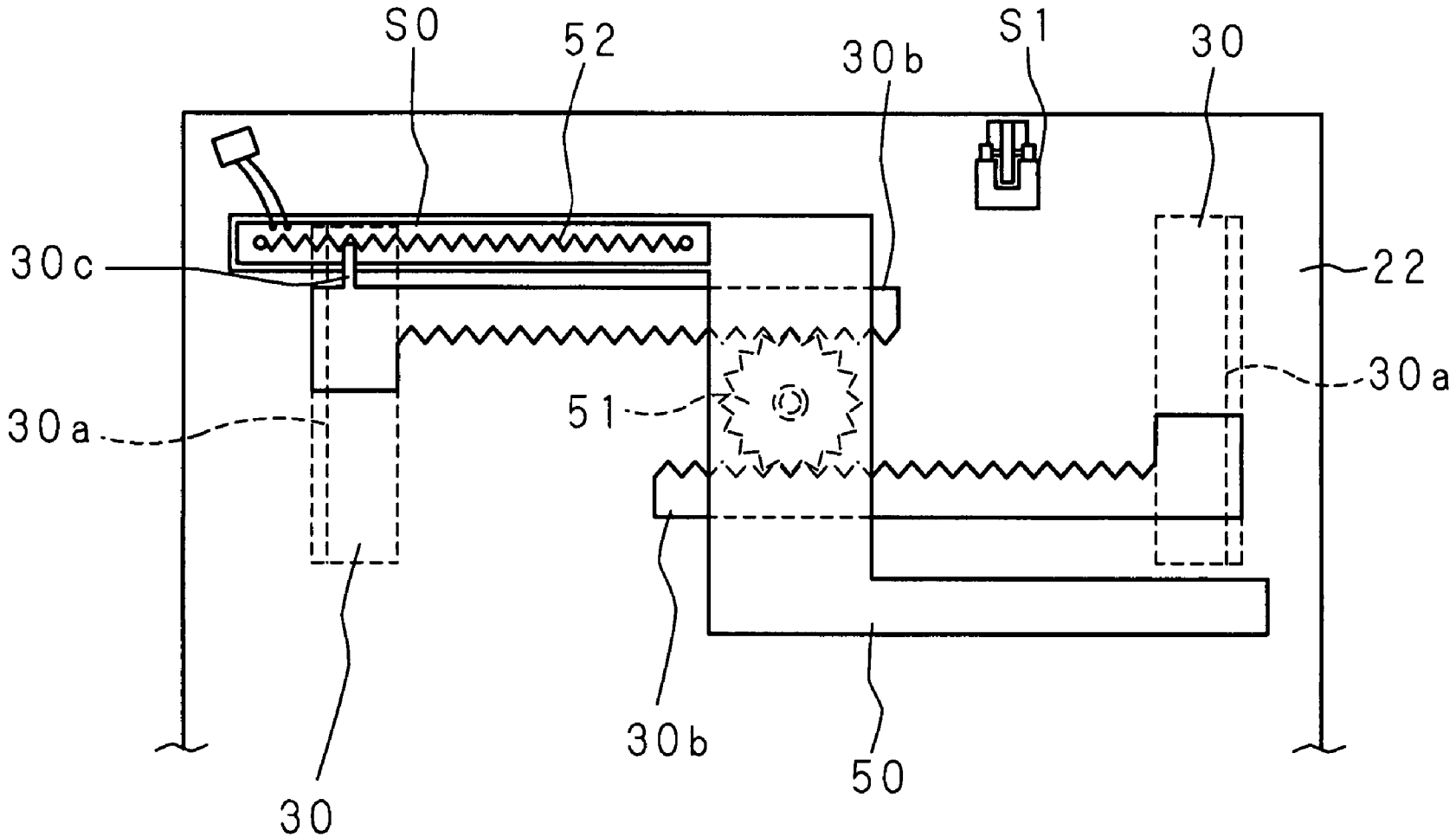
FIG. 5 is a bottom view of a document tray seen from the back side.

FIG. 5 is a bottom view of the document tray 22 seen from the back side. The document regulating plate 30 comprises a pair of side plates 30*a* and 30*a* for aligning the both sides, in a main scanning direction (direction orthogonal to the document feed direction), of documents; and rack gear portions 30*b* and 30*b* which are connected to one end of the respective side plates 30*a* and 30*a* and extended in the main scanning direction. The rack gear portions 30*b* and 30*b* are supported by a guide member (not shown) so that they can freely slide in the main scanning direction with respect to the document tray 22, i.e., one pair of side plates 30*a* and 30*a* come closer to or are separated from each other.

One pair of rack gear portions 30*b* and 30*b* are held by a holding member 50, and engage with a pinion gear 51 mounted near the center of the document tray 22 so that they face each other. Thus, when one side plate 30*a* is manipulated, the other side plate 30*a* is linked with the side plate 30*a* and also displaced.

Besides, the first document size detector S0 is constructed as described in Japanese Patent Application Laid-Open No. 7-17640 (1995), for example. Specifically, a resistor 52 is placed parallel to the rack gear portion 30*b*, and, when a contact tongue 30*c* provided on the side plate 30*a* comes into contact with the top of the resistor 52, a change in the resistance between the contact tongue 30*c* and one end of the resistor 52 is detected so as to detect the position of the side plate 30*a*. The first document size detector S0 is a so-called slide volume type detector.

FIGS. 6A, 6B, 7A and 7B are side views for explaining the operation of the document tray 22. As described above, the document tray 22 can swing on the fulcrum 22*a*, and the rib 22*b* provided on the opposite end to the fulcrum 22*a* can be elevated by pushing it up by the elevation/lowering plate 31, but the rib 22*b* is lowered when the elevation/lowering plate 31 is lowered (see FIG. 6A).

Figure 7A:
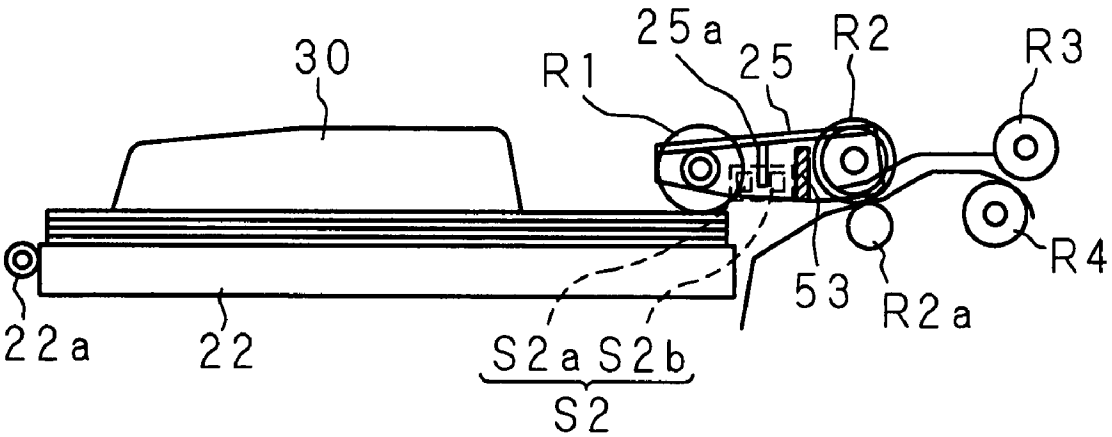
Figure 7B:
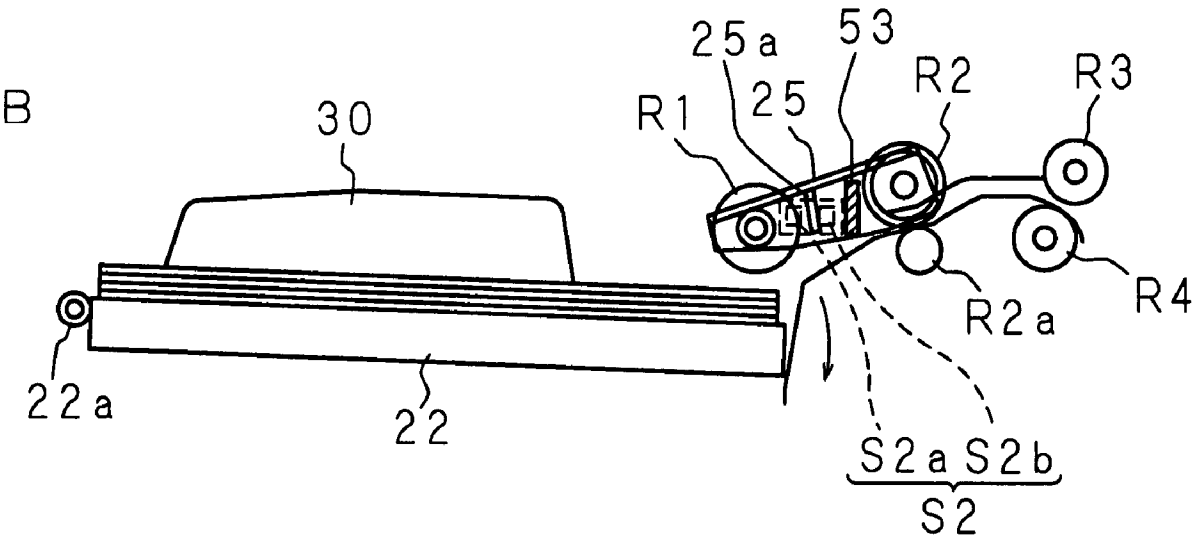

For example, when there is a relationship shown in FIG. 7B between the height position of the topmost layer of documents and the position of the guide-in roller R1 at the time the documents are mounted on the document tray 22, a light shielding plate 25*a* blocks light between one pair of light emitting element S2*a* and light receiving element S2*b* of the guide-in roller position detector S2 to produce a state in which an optical path between the two elements S2*a* and S2*b* is not formed, i.e., the guide-in roller position detector S2 is in an OFF state.

In this case, the controller 41 elevates the document tray 22 by pushing up the elevation/lowering plate 31, and stops the elevation of the document tray 22 when the optical path between the pair of light emitting element S2*a* and light receiving element S2*b* of the guide-in roller position detector S2 has just been formed, i.e., when the guide-in roller position detector S2 has just been turned on.

Consequently, the guide-in roller R1 comes into contact with the topmost layer of the stack of documents due to its own weight or exerting force of the guide-in roller R1, arm 25, etc., goes into a state capable of feeding documents immediately, and turns into to a standby state.

Figure 6A:
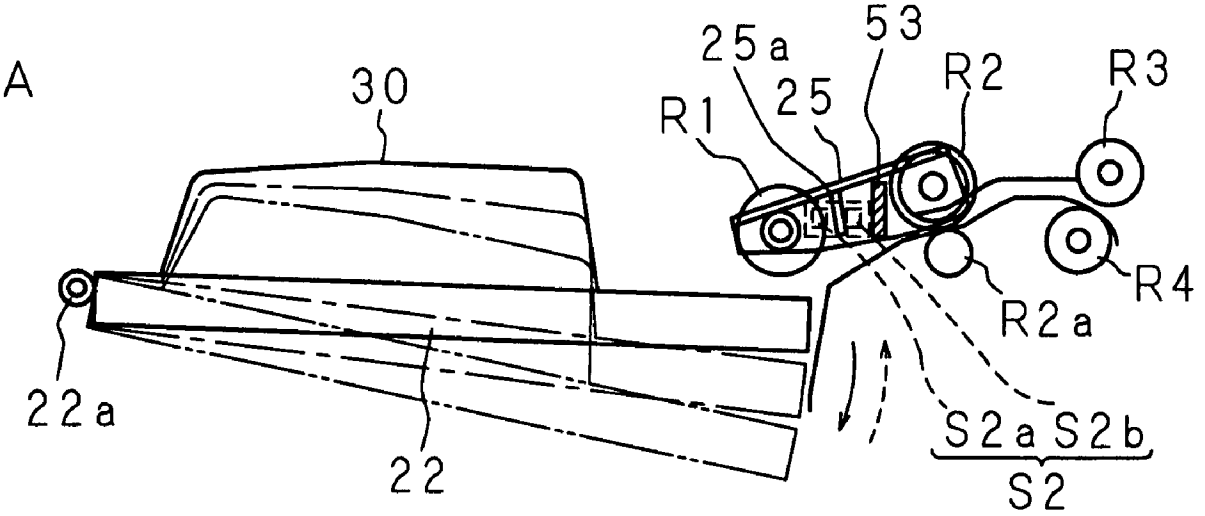
FIGS. 6A, 6B, 7A and 7B are side views for explaining the operation of the document tray.
Figure 6B:
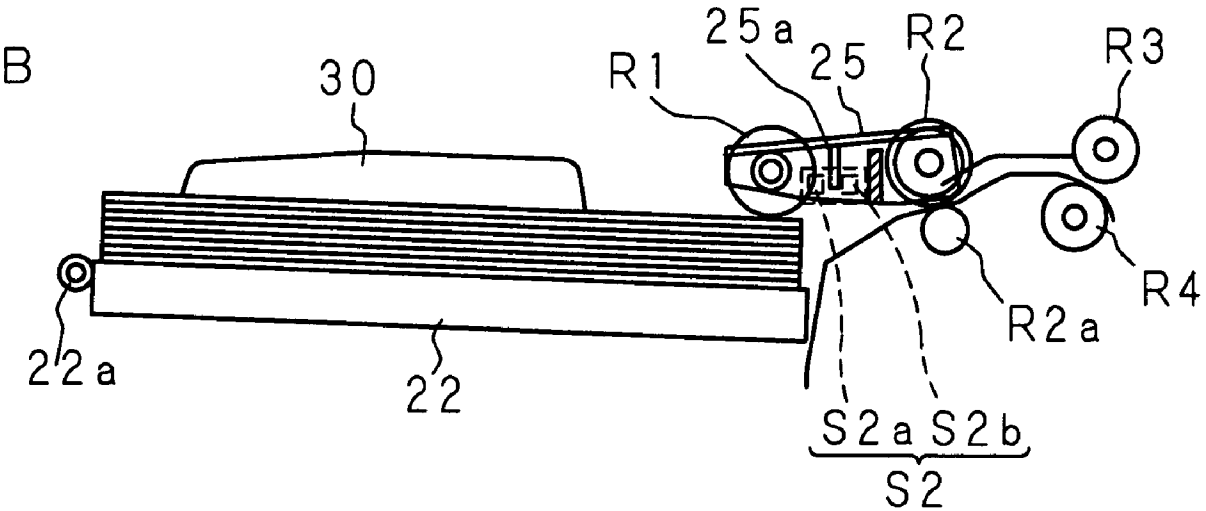

Moreover, as shown in FIG. 6B, for example, when too may documents are placed, i.e., when the guide-in roller R1 is pushed up above a height appropriate for document feeding by the topmost layer of the stack of documents, the light shielding plate 25*a* attached to the arm 25 does not block light between the pair of light emitting element S2*a* and light receiving element S2*b* of the guide-in roller position detector S2 arranged in a fixed position, and the optical path between the two elements S2*a* and S2*b* is formed. In other words, although the guide-in roller position detector S2 is in the ON state, this state may not be a state switched from the OFF state to the ON state.

When conveying documents, satisfactory conveyance may not be performed in this state, and therefore the document tray 22 is lowered temporarily for safety reasons. Then, as shown in FIG. 7B, the light shielding plate 25*a* blocks light between the light emitting element S2*a* and light receiving element S2*b* of the guide-in roller position detector S2, and produces a state in which the optical path between the two elements S2*a* and S2*b* is not formed, i.e., the guide-in roller position detector S2 is in the OFF state.

Next, the controller 41 controls the document tray 22 again to elevate the document tray 22 until the guide-in roller position detector S2 is turned off. As a result, the guide-in roller R1 comes into contact with the topmost layer of the stack of documents due to the own weight or exerting force of the guide-in roller R1, arm 25, etc., and the sheet feeder goes into a state capable of feeding documents immediately and turns into a standby state.

Referring to the flowcharts, the following description will explain the operation of the image reading apparatus 1 constructed as mentioned above.

Figure 8:
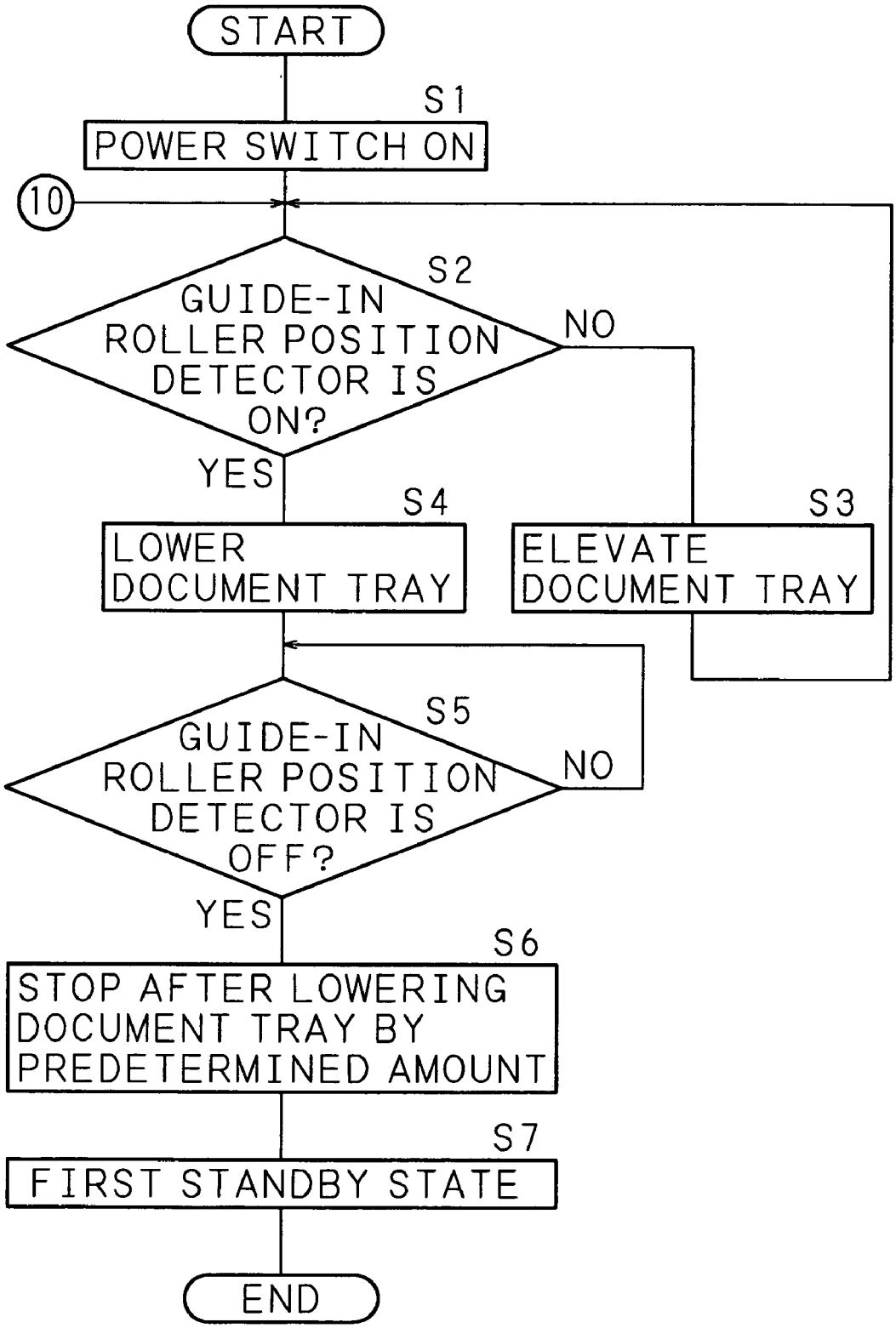
FIG. 8 is a flowchart for explaining the control procedure of a controller from supply of power until the document tray goes into a standby state.

FIG. 8 is a flowchart for explaining the control procedure of the controller 41 from supply of power until the document tray 22 goes into a standby state. First, when the power switch (not shown) is ON (step S1), the controller 41 judges whether or not the output of the guide-in roller position detector S2 is turned on, i.e., whether or not the optical path between the elements S2*a* and S2*b* is formed (step S2).

When it is judged that the output of the guide-in roller position detector S2 is not turned on (S2: NO), the controller 41 drives and controls the elevation/lowering motor 33 to elevate the document tray 22 (step S3). When the document tray 22 is elevated, the guide-in roller R1 is pushed up and the optical path between the elements S2*a* and S2*b* is formed, i.e., when it is judged that the output of the guide-in roller position detector S2 is turned on (S2: YES), the controller 41 drives and controls the elevation/lowering motor 33 to start to lower the document tray 22 (step S4).

Next, the controller 41 judges consecutively whether or not the output of the guide-in roller position detector S2 is turned off (step S5), and waits until the output of the guide-in roller position detector S2 is turned off (S5: NO). During this time, the controller 41 drives and controls the elevation/lowering motor 33 to lower the document tray 22 successively.

When it is judged that the output of the guide-in roller position detector S2 is turned off (step S5: YES), the controller 41 drives the elevation/lowering motor 33 from this state by a predetermined number of steps to lower the document tray 22 and then stops the document tray 22 (step S6), and thereby moving the document tray 22 to the position of a first standby state and keeping the document tray 22 in this position (step S7). Here, the first standby state is a state before documents are set, and the height position of the document tray 22 is a height preset by a service person or a user by operating the operation section 46 according to a frequently set number of documents on the document tray 22 as described above. In this state, the controller 41 stops the control temporarily.

Figure 9:
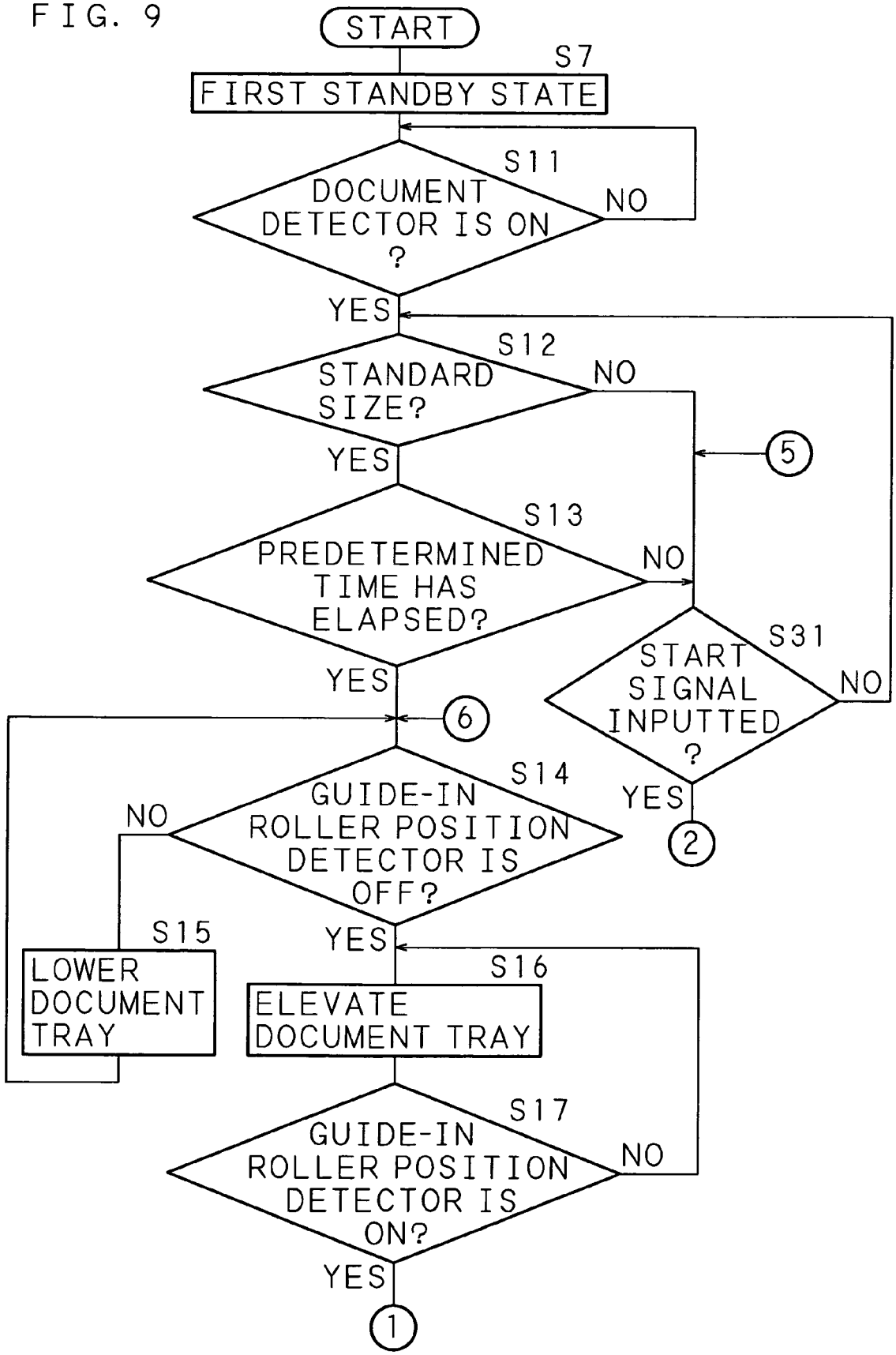
FIGS. 9 through 11 show a flowchart illustrating the control procedure from setting of documents to reading of documents.
Figure 10:
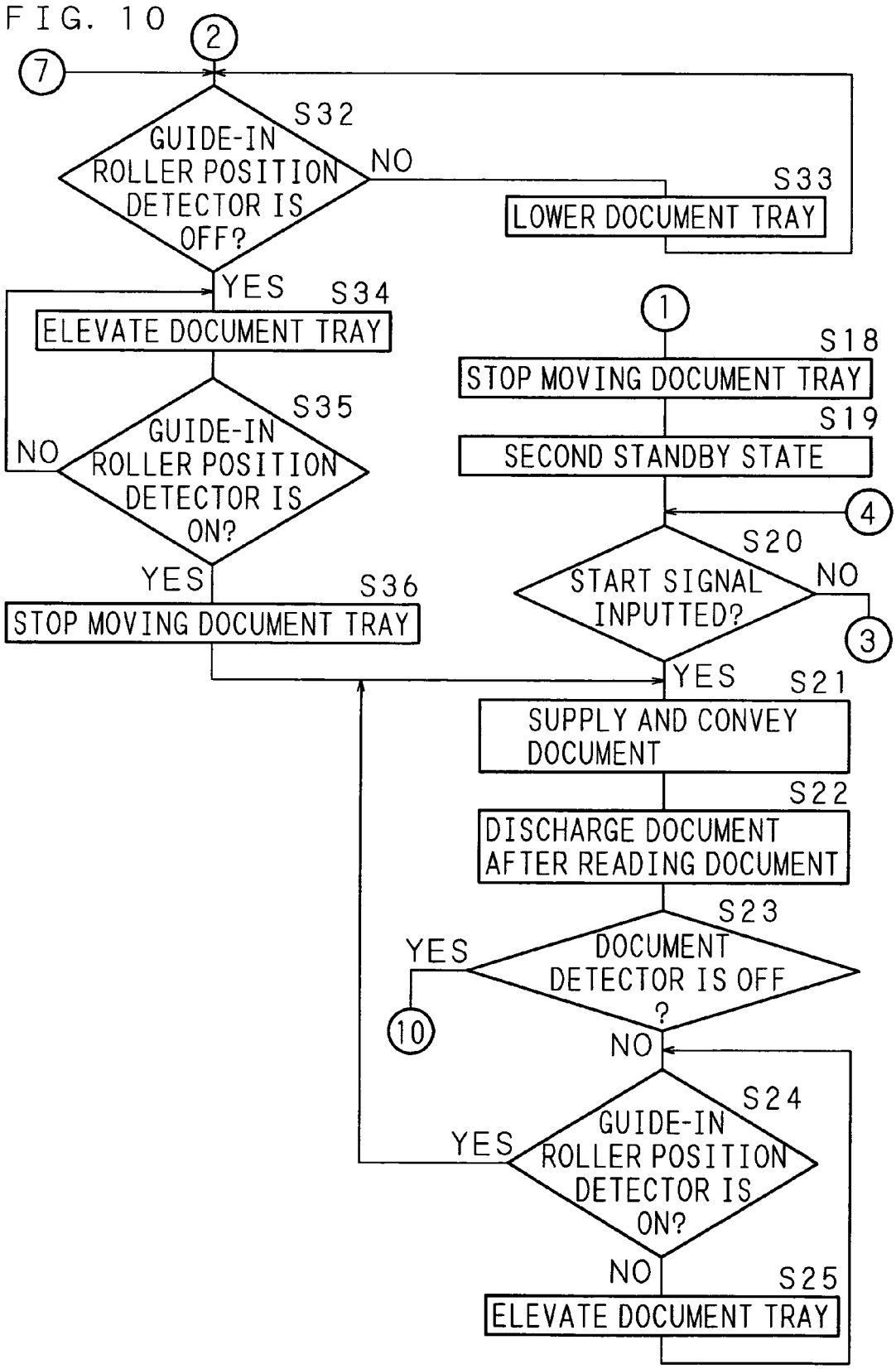
Figure 11:
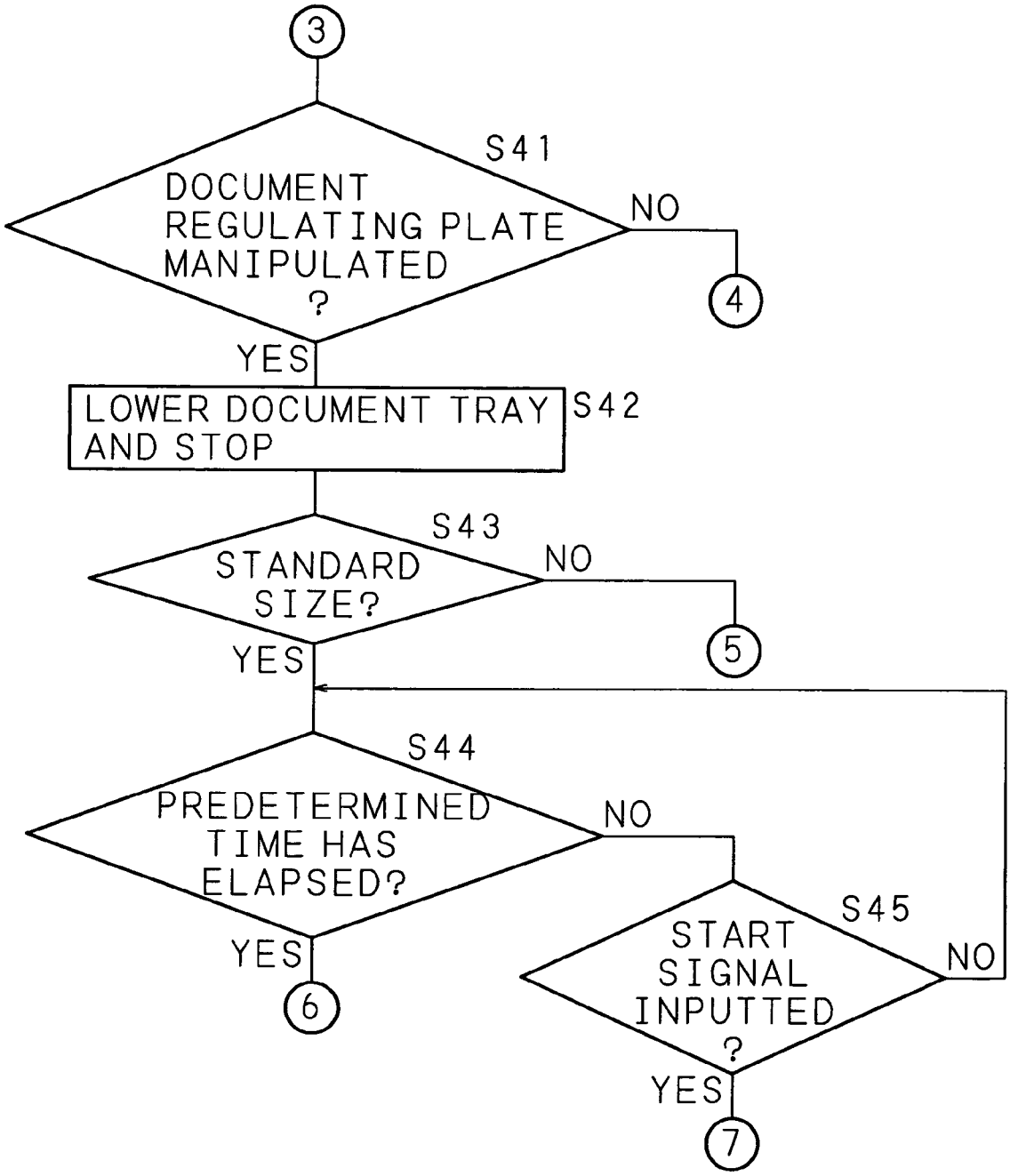
Figure 12:
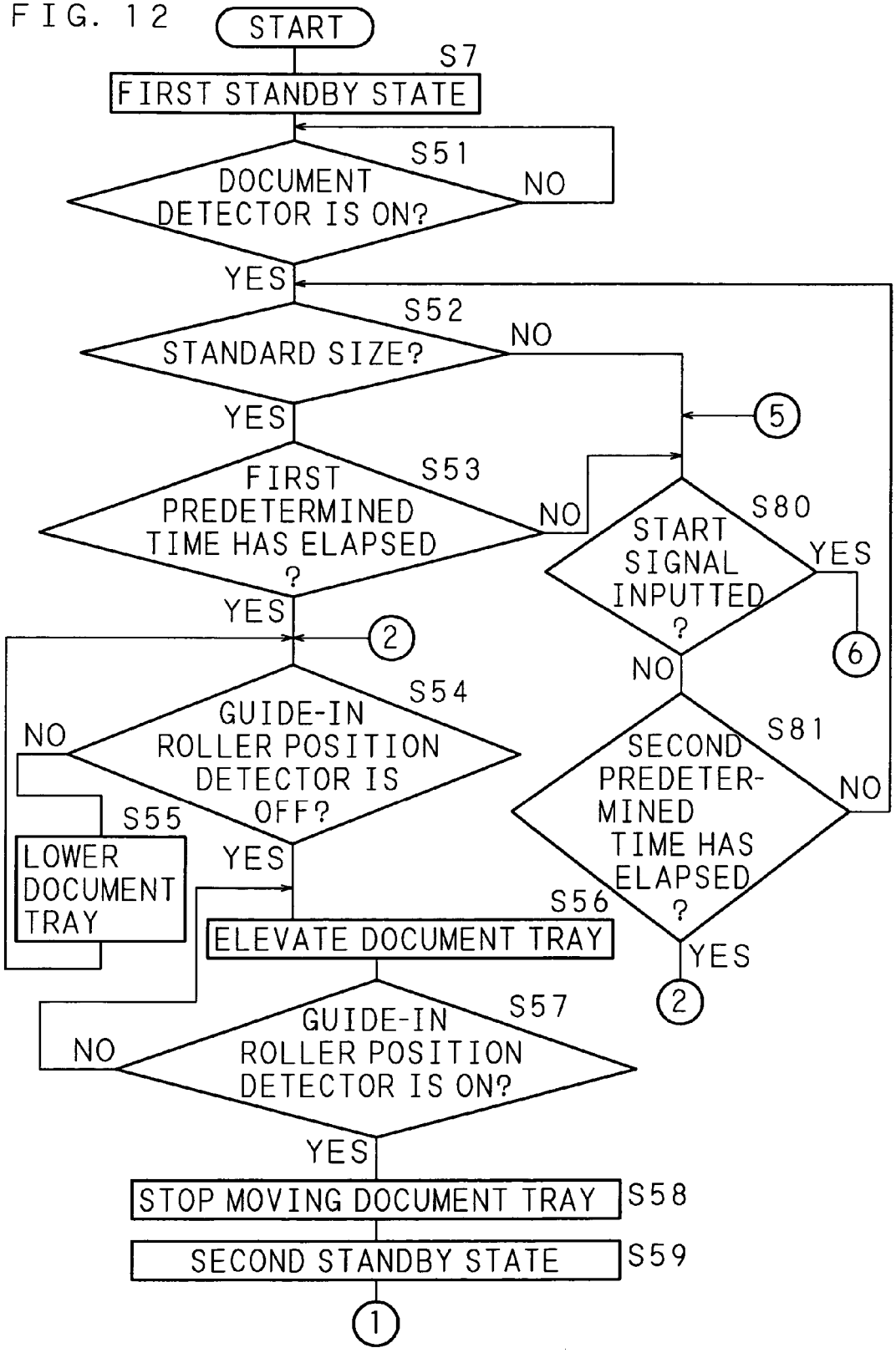
FIGS. 12 through 15 show a flowchart for explaining the control procedure to be performed by the image reading apparatus according to an embodiment of the present invention.
Figure 13:
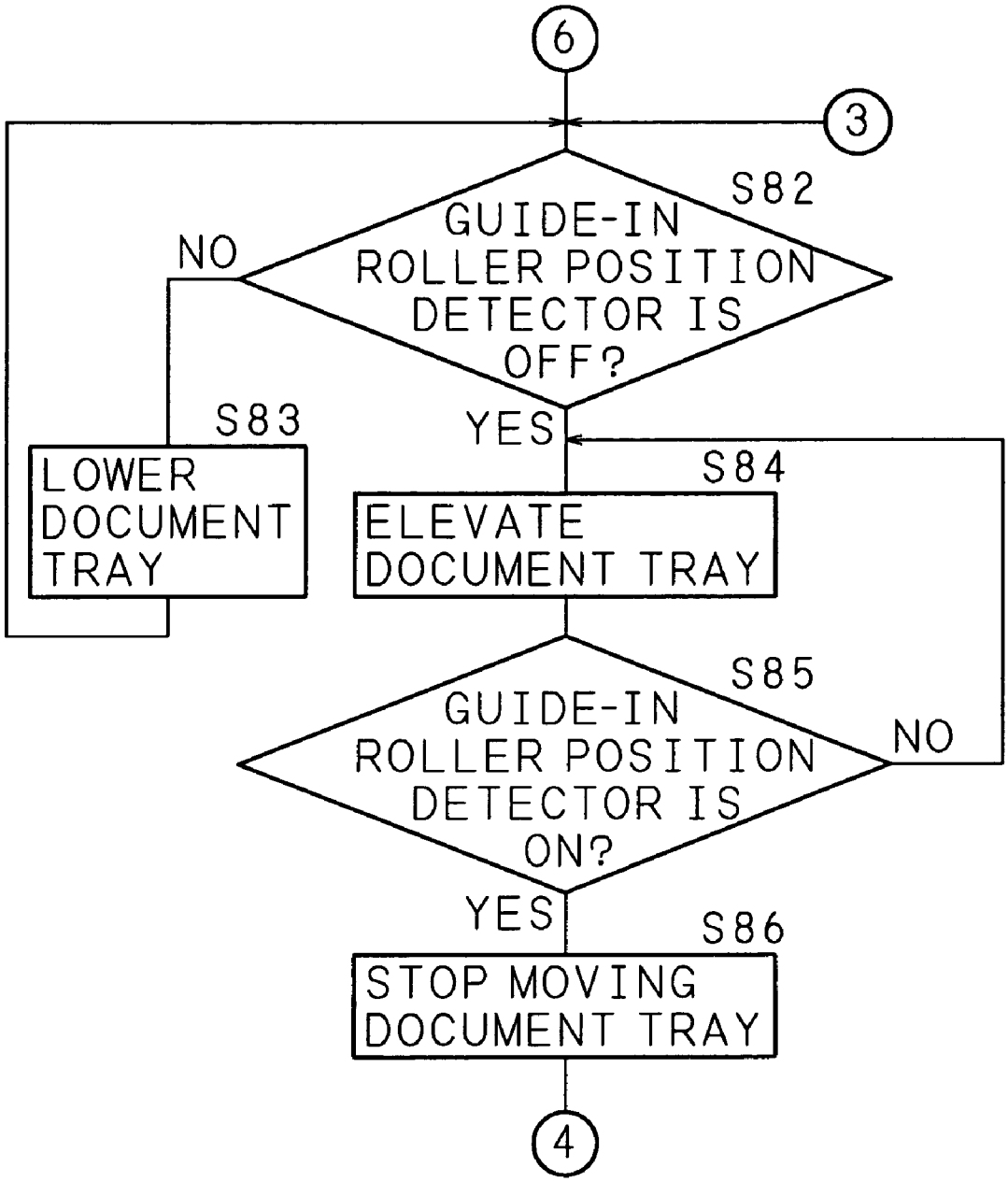
Figure 14:
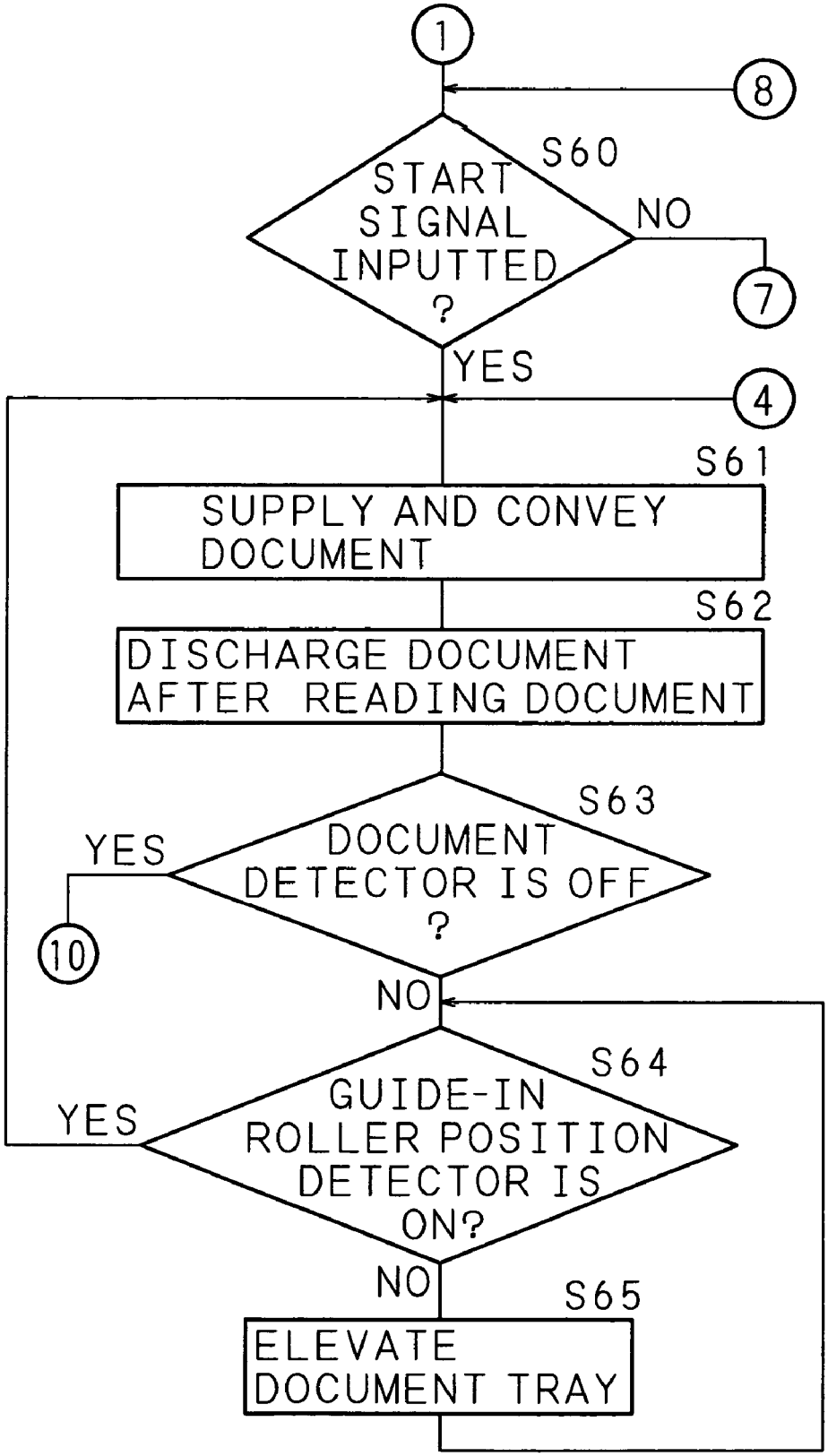
Figure 15:
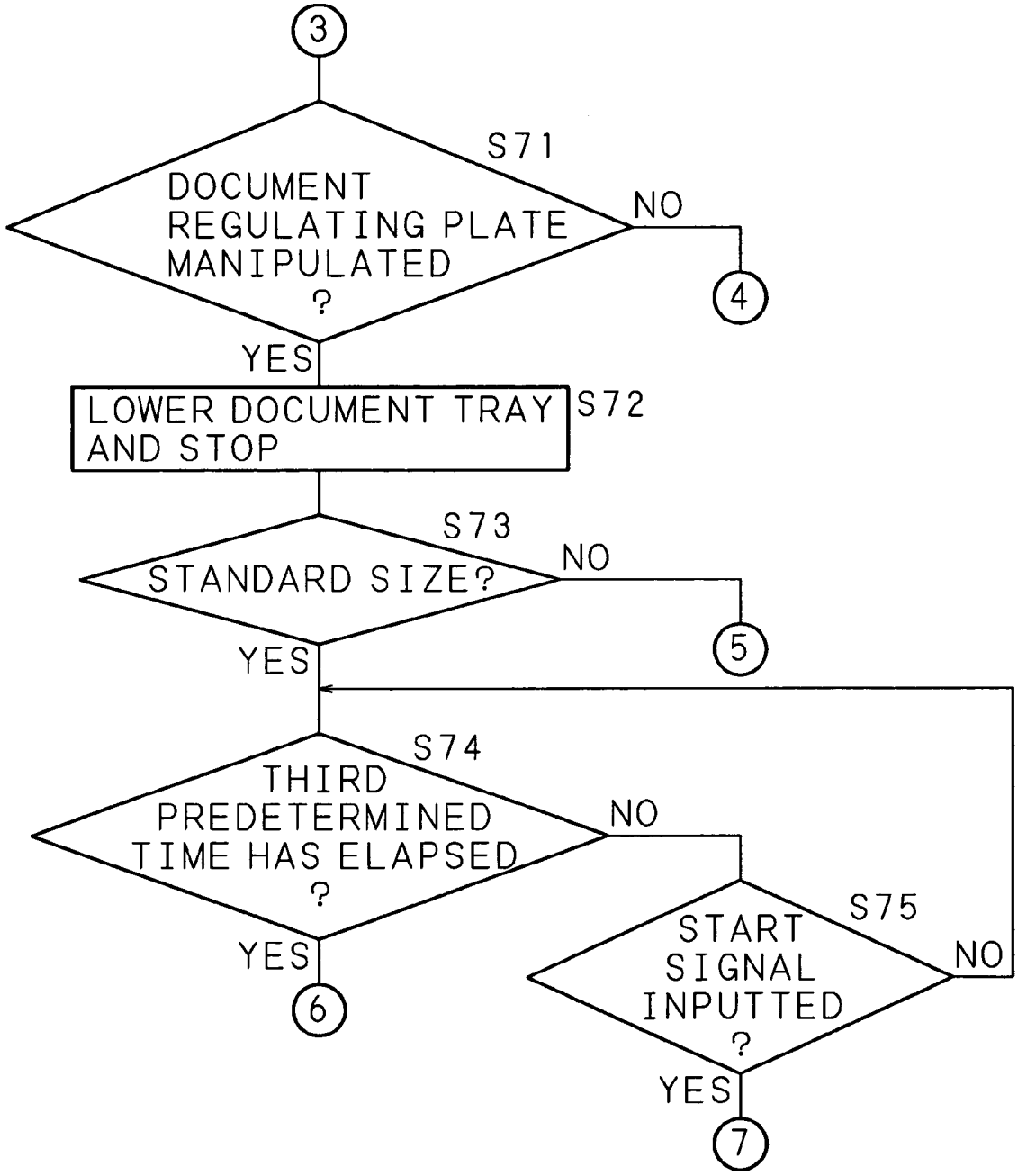

FIGS. 9 through 11 show a flowchart illustrating the control procedure from setting of documents to reading of documents. It is supposed that the document tray 22 is in the first standby state under the above-mentioned control in setting documents on the document tray 22 (step S7).

First, the controller 41 judges whether or not the output of the document detector S1 is ON (step S11), and thereby judging whether or not a document is set on the document tray 22. When the output of the document detector S1 is OFF (S11: NO), the controller 41 judges that a document is not set on the document tray 22 and waits until a document is set.

When the output of the document detector S1 is ON (S11: YES), i.e., when the controller 41 judges that a document is set on the document tray 22, the first document size detector S0 detects the size of the document and the controller 41 judges whether or not the set document is of a standard size (step S12). When judging whether or not the document is of a standard size, the controller 41 reads the above-mentioned document size table from the storing section 49, and judges whether or not the value detected by the first document size detector S0 corresponds to a value stored in the table. Here, a document size set by the user from the operation section 46 (user-set value) is also dealt as a standard size. Moreover, since the first document size detector S0 detects the size of the document by the position of the side plate 30*a* of the document regulating plate 30, the detection value includes some error. Therefore, when the detection value is compared with the value stored in the table, it is desirable to take into account a predetermined allowable margin of error to judge whether or not the set document is of a standard size.

When it is judged that the document is of a standard size (S12: YES), it is judged whether or not a predetermined time has elapsed by using the timer function of the controller 41 or the like (step S13). When it is judged that the document is not of a standard size in step S12 (S12: NO), or before the elapse of a predetermined time (S13: NO), it is judged whether or not a start signal for starting to read the document has been inputted by operating the operation section 46 (step S31). When the start signal has been inputted (S31: YES), the processes in and after step S32 described later are executed, or, when the start signal has not been inputted (S31: NO), the controller 41 returns to the process in step S12.

When the predetermined time has elapsed (S13: YES), the controller 41 judges whether or not the output of the guide-in roller position detector S2 is turned off (step S14). When the output of the guide-in roller position detector S2 is not turned off (S14: NO), i.e., when the guide-in roller R1 comes into contract with the document in the height position (first standby state) of the document tray 22 at that time because the stack of documents is thick, the controller 41 lowers the document tray 22 by only a predetermined amount (step S15) and returns to the process in step S14.

Thus, by repeatedly performing the processes in steps S14 and S15, even when documents more than a preset number of documents are forcibly mounted on the document tray 22, the controller 41 can confirm whether the guide-in roller R1 is not higher than a predetermined height for supply and conveyance of documents. Then, when the height position of the guide-in roller R1 is higher than the predetermined height, the controller 41 lowers the document tray 22 by only a predetermined amount because there is a possibility that the guide-in roller R1 may cause troubles in the supply and conveyance of documents.

With the above-mentioned control, when it is judged that the output of the guide-in roller position detector S2 is turned off (S14: YES), the controller 41 starts to elevate the document tray 22 (step S16), and judges whether or not the output of the guide-in roller position detector S2 is turned on (S17). When the output of the guide-in roller position detector S2 is not turned on (S17: NO), the controller 41 returns to the process in step S16. In other words, the document tray 22 continues to be elevated until the output of the guide-in roller position detector S2 is turned on.

Then, when the output of the guide-in roller position detector S2 is turned on (S17: YES), the controller 41 stops moving the document tray 22 (step S18). Consequently, the elevation of the document tray 22 is finished, and the document tray 22 goes into a second standby state (step S19).

The second standby state is a state in which setting of documents has been completed and supply and conveyance of documents are ready, and the height position of the document tray 22 is a height corresponding to the actual number of documents set on the document tray 22 at this time.

Next, the controller 41 judges whether or not a start signal for starting the document reading process has been inputted (step S20). When it is judged that the start signal has been inputted (S20: YES), the controller 41 supplies and conveys a document (step S21), and discharges the document onto the sheet discharge tray 17 after reading the image of the document (step S22). During this time, the controller 41 judges whether or not the output of the document detector S1 is turned off (step S23), and judges whether or not all the documents on the document tray 22 have been fed.

When the output of the document detector S1 is turned off (S23: YES) and it is judged that all the documents have been fed, the controller 41 returns to the process in step S2 mentioned above. Thereafter, the document tray 22 returns to the first standby state.

When the output of the document detector S1 is not OFF in step S23 (S23: NO), i.e., when successive documents still remain on the document tray 22, the controller 41 judges whether or not the output of the guide-in roller position detector S2 is turned on (step S24).

When the output of the guide-in roller position detector S2 is OFF (S24: NO), i.e., when the height of the guide-in roller R1 was lowered with a decrease in the height of the stack of documents, the controller 41 elevates the document tray 22 by only a predetermined amount (step S25). Thereafter, the controller 41 returns to the process in step S24, and elevates the document tray 22 until the output of the guide-in roller position detector S2 is turned on.

When the output of the guide-in roller position detector S2 is ON in step S24 (S24: YES), the controller 41 returns to the process in step S21, and performs the supply and conveyance of documents and the reading of documents.

Thus, as a document on the document tray 22 is taken in, the document tray 22 is elevated to maintain the topmost layer of the stack of documents at a fixed height while the supply of document in step S21 and the reading process in step S22 are performed.

On the other hand, when a start signal for starting to read a document was inputted in step S31 (S31: YES), the controller 41 judges that setting of documents has been completed, and executes the same processes as those in the above mentioned steps S14 through S18 to prepare for the supply and conveyance of documents. Specifically, the controller 41 judges whether or not the output of the guide-in roller position detector S2 is turned off (step S32), and, if the output is not turned off (S32: NO), the controller 41 lowers the document tray 22 by only a predetermined amount (step S33) and returns to the process in step S32.

When it is judged that the output of the guide-in roller position detector S2 is turned off (S32: YES) with the control of steps S32 and S33, the controller 41 starts to elevate the document tray 22 (step S34), and judges whether or not the output of the guide-in roller position detector S2 is turned on (step S35). When the output of the guide-in roller position detector S2 is not turned on (S35: NO), the controller 41 returns to the process in step S34. In other words, the document tray 22 continues to be elevated until the output of the guide-in roller position detector S2 is turned on.

Then, when the output of the guide-in roller position detector S2 is turned on (S35: YES), the controller 41 stops moving the document tray 22 (step S36). After stopping the movement of the document tray 22, the controller 41 executes the processes in the above-mentioned steps S21 through S25 to perform the supply and conveyance of document and the reading process.

On the other hand, when the start signal has not been inputted in step S20 (S20: NO), the controller 41 judges whether or not the document regulating plate 30 has been manipulated (step S41). When the document regulating plate 30 has been manipulated (S41: YES), the controller 41 judges that new document is to be added to the document tray 22, and lowers the document tray 22 by only a predetermined height and then stops the document tray 22 (step S42). On the other hand, when the document regulating plate 30 has not been manipulated (S41: NO), the controller 41 returns to the process in step 20.

Next, the first document size detector S0 detects whether or not the document is of a standard size (step S43). When the document is of a standard size (S43: YES), it is judged whether or not a predetermined time has elapsed from the end of manipulation of the document regulating plate 30 by using the timer function of the controller 41 or the like (step S44). When the predetermined time has elapsed (S44: YES), the controller 41 returns to the process in step S14, and performs the control in steps S14 through S18 to stop the document tray 22 in the second standby state.

Moreover, before the elapse of the predetermined time (S44: NO), it is judged whether or not a start signal for starting the reading process has been inputted (step S45). When the start signal has been inputted (S45: YES), the controller 41 returns to the process in step S32, or, when the start signal has not been inputted (S45: NO), the controller 41 returns to the process in step S44. Further, when the document size detected by the first document size detector S0 in step S43 is not of a standard size (S43: NO), the controller 41 returns to the process in step S31.

As described above, when the detection result of the first document size detector S0 shows a value corresponding to a preset size, the controller 41 judges that the document is set properly and moves the document tray 22 to cause the document to come into contact with the guide-in roller R1. On the other hand, when the detection result of the first document size detector S0 shows a value that does not correspond to a preset size, the controller 41 judges that the document regulating plate 30 is not set properly and does not start the movement of the document tray 22. Consequently, it is possible to prevent the movement of the document tray 22 from being started in an imperfectly set condition of sheets on the document tray 22, thereby solving the problems of conveyance of the documents in the imperfectly set condition to the guide-in roller R1 and displacement or tilting of the position of the formed image.

Further, although the flowchart of FIG. 8 from the supply of power to the first standby state explains a method that does not use a detector for directly detecting the position of the document tray 22, the height of the document tray 22 may be controlled using a detector for directly detecting the position of the document tray 22. For example, it is possible to provide a detector for detecting the lowest point of the document tray 22 and adjust the document tray 22 to a preset height of the document tray 22 in the first standby state on the basis of the detection signal from the detector, or to use a detector for detecting the highest point of the document tray 22. In general, the height of the document tray 22 in the initial state (at the time of supply of power) is the lowest point capable of mounting the maximum number of sheets, but it may be set in an arbitrary mid height.

Second Embodiment

In the first embodiment, when the document is not of a standard size in step S12, the controller 41 moves to step S31, but, when the start signal is not inputted from the operation section 46 at this time, the controller 41 returns to step S12 again. Consequently, preparation for the supply and conveyance of documents (producing a state in which the document tray 22 is elevated, the guide-in roller R1 is in contact with the topmost layer of the stack of documents, and the documents can be fed immediately) can not be performed unless the user presses the Start key K13 and operates the operation section 46 to instruct the reading of documents. Hence, in the second embodiment, even when the start signal is not inputted, if a predetermined time (a second predetermined time) has elapsed, the document tray 22 is moved into the second standby state to prepare for the supply and conveyance of documents.

Note that since the configuration and operational principle of the image reading apparatus 1 are exactly the same as those in the first embodiment, the explanation thereof is omitted.

FIGS. 12 through 15 show a flowchart for explaining the control procedure to be performed by the image reading apparatus 1 of this embodiment. It is supposed that the document tray 22 is on standby in the first standby state in reading a document (step S7). Note that the height of the document tray 22 in the first standby state is changeable, and the user can set the height from the operation section 46 based on a request of the user or the past history.

First, the controller 41 of the image reading apparatus 1 judges whether or not the output of the document detector S1 is ON (step S51), and thereby judging whether or not a document is set on the document tray 22. When the output of the document detector S1 is OFF (S51: NO), the controller 41 judges that a document is not set on the document tray 22 and waits until a document is set.

When the output of the document detector S1 is ON (S51: YES), i.e., when the controller 41 judges that a document is set on the document tray 22, the first document size detector S0 detects the size of the document and the controller 41 judges whether or not the set document is of a standard size, with reference to the document size table stored in the storing section 49 (step S52).

When it is judged that the document is of a standard size (S52: YES), it is judged whether or not a first predetermined time (for example, several seconds) has elapsed by using the timer function of the controller 41 or the like (step S53). When the first predetermined time has elapsed (S53: YES), the controller 41 judges whether or not the output of the guide-in roller position detector S2 is turned off (step S54). When the output of the guide-in roller position detector S2 is not turned off (S54: NO), i.e., when the guide-in roller R1 comes into contract with the document in the height position (first standby state) of the document tray 22 at that time because the stack of documents is thick, the controller 41 lowers the document tray 22 by only a predetermined amount (step S55) and returns to the process in step S54. In the process of step S54, the controller 41 confirms whether or not the guide-in roller R1 becomes higher than a predetermined height for supply and conveyance of documents for some reason such as forcibly mounting a number of documents more than a preset number on the document tray 22. This confirmation is performed because the guide-in roller R1 positioned higher than the predetermined height may cause troubles in the supply and conveyance of documents.

With such control, when it is judged that the output of the guide-in roller position detector S2 is turned off (S54: YES), the controller 41 starts to elevate the document tray 22 (step S56), and judges whether or not the output of the guide-in roller position detector S2 is turned on (step S57). When the output of the guide-in roller position detector S2 is not turned on (S57: NO), the controller 41 returns to the process in step S56. In other words, the document tray 22 continues to be elevated until the output of the guide-in roller position detector S2 is turned on.

Then, when the output of the guide-in roller position detector S2 is turned on (S57: YES), the controller 41 stops the movement of the document tray 22 (step S58). Consequently, the elevation of the document tray 22 is finished, and the document tray 22 goes into the second standby state (step S59).

On the other hand, when it is judged that the document is not of a standard size in step S52 (S52: NO), or before the elapse of the first predetermined time (S53: NO), it is judged whether or not a start signal for starting to read the document has been inputted by operating the operation section 46 (step S80). When the start signal has been inputted (S80: YES), the processes in and after step S82 described later are executed, or, when the start signal has not been inputted (S80: NO), it is judged whether or not the second predetermined time has elapsed (step S81).

Here, the second predetermined time can be set within a range of 0 second to several minutes, for example, from the operation section 46. Similarly, the first predetermined time can also be set within a range of 0 second to 10 seconds, for example, from the operation section 46. Note that it is desirable to set the second predetermined time longer than the first predetermined time.

When the second predetermined time has not elapsed (S81: NO), the controller 41 returns to the process in step S52, or, when the second predetermined time has elapsed (S81: YES), the controller 41 moves to the process in step S54 and causes the document tray 22 to wait in a state capable of supplying and conveying documents, namely in the second standby state.

Note that, when a detection value which does not correspond to a standard size is obtained in step S52, the document tray 22 may be controlled to move to a height just before the second standby state instead of elevating the document tray 22 to the second standby state after the elapse of the second predetermined time and stopping it. With such control, it is possible to easily maintain a state in which the document regulating plate 30 can be manipulated after elevating and stopping the document tray 22, thereby preventing the documents from being fed in an imperfectly set condition due to the displacement of the position of the document regulating plate 30.

When it is judged in step S80 that a start signal for starting to read a document has been inputted (S80: YES), the controller 41 judges that setting of documents has been completed and executes the same processes as those in the above mentioned steps S54 through S58 to prepare for the supply and conveyance of documents. Specifically, the controller 41 judges whether or not the output of the guide-in roller position detector S2 is turned off (step S82), and, if the output is not turned off (S82: NO), the controller 41 lowers the document tray 22 by only a predetermined amount (step S83) and returns to the process in step S82.

When it is judged that the output of the guide-in roller position detector S2 is turned off (S82: YES) with the control of steps S82 and S83, the controller 41 starts to elevate the document tray 22 (step S84), and judges whether or not the output of the guide-in roller position detector S2 is turned on (step S85). When the output of the guide-in roller position detector S2 is not turned on (S85: NO), the controller 41 returns to the process in step S84. In other words, the document tray 22 continues to be elevated until the output of the guide-in roller position detector S2 is turned on.

Then, when the output of the guide-in roller position detector S2 is turned on (S85: YES), the controller 41 stops the movement of the document tray 22 (step S86). At this time, the document tray 22 goes into the second standby state capable supplying and conveying documents.

Next, the controller 41 judges whether or not a start signal for starting the document reading process has been inputted (step S60). When it is judged that the start signal has been inputted (S60: YES), the controller 41 supplies and conveys the documents (step S61), and discharges the documents onto the sheet discharge tray 17 after reading the images of the documents (step S62). During this time, the controller 41 judges whether or not the output of the document detector S1 is turned off (step S63), thereby judging whether or not all the documents on the document tray 22 have been fed.

When the output of the document detector S1 is turned off (S63: YES) and it is judged that all the documents have been fed, the controller 41 returns the document tray 22 to the first standby state (see FIG. 8).

When the output of the document detector S1 is not OFF in step S63 (S63: NO), i.e., when successive documents still remain on the document tray 22, the controller 41 judges whether or not the output of the guide-in roller position detector S2 is turned on (step S64).

When the output of the guide-in roller position detector S2 is OFF (S64: NO), i.e., when the height of the guide-in roller R1 is lowered with a decrease in the height of the stack of documents, the controller 41 elevates the document tray 22 by only a predetermined amount (step S65). Thereafter, the controller 41 returns to the process in step S64, and elevates the document tray 22 until the output of the guide-in roller position detector S2 is turned on. When the output of the guide-in roller position detector S2 is ON in step S64 (S64: YES), the controller 41 returns to the process in step S61, and performs the supply and conveyance of document and the document reading process.

Thus, as a document on the document tray 22 is taken in, the document tray 22 is elevated to maintain the topmost layer of the stack of documents at a fixed height, and the supply of document in step S61 and the document reading process in step S62 are performed.

On the other hand, when the start signal has not been inputted in step S60 (S60: NO), the controller 41 judges whether or not the document regulating plate 30 has been manipulated (step S71). When the document regulating plate 30 has been manipulated (S71: YES), the controller 41 judges that new document is to be added to the document tray 22, and lowers the document tray 22 by only a predetermined height and then stops the document tray 22 (step S72). On the other hand, when the document regulating plate 30 has not been manipulated (S71: NO), the controller 41 returns to the process in step S60.

Next, the first document size detector S0 detects whether or not the document is of a standard size (step S73). When the document is of a standard size (S73: YES), it is judged whether or not a third predetermined time has elapsed from the end of manipulation of the document regulating plate 30 by using the timer function of the controller 41 or the like (step S74). Here, the third predetermined time may have the same value as the first predetermined time, or may be 0 second.

When the third predetermined time has elapsed (S74: YES), the controller 41 returns to the process in step S54, and performs the control in steps S54 through S58, thereby stopping the document tray 22 in the second standby state.

Moreover, before the elapse of the predetermined time (S74: NO), it is judged whether or not a start signal for starting the reading process has been inputted (step S75). When the start signal has been inputted (S75: YES), the controller 41 returns to the process in step S82, or, when the start signal has not been inputted (S75: NO), the controller 41 returns to the process in step S74. Further, when the document size detected by the first document size detector S0 in step S73 is not of a standard size (S73: NO), the controller 41 returns to the process in step S80.

As described above, when the detection result of the first document size detector S0 shows a value corresponding to a preset size, the controller 41 judges that the document is set properly and moves the document tray 22 to cause the document to come into contact with the guide-in roller R1. On the other hand, when the detection result of the first document size detector S0 shows a value that does not correspond to a preset size, the controller 41 judges that the document regulating plate 30 is not set properly and does not start the movement of the document tray 22. Consequently, it is possible to prevent the movement of the document tray 22 from being started in an imperfectly set condition of sheets on the document tray 22, thereby solving the problems of conveyance of documents in the imperfectly set condition to the guide-in roller R1 and displacement and tilting of the position of the formed image.

Note that although not shown in the flowcharts, with the elapse of the predetermined time after setting documents, when the document tray is elevated to a state capable of supplying and conveying documents (the second standby state), if a document is pulled out forcibly, the controller 41 uses the detection result of the document detector S1 as a trigger and controls the document tray 22 to wait in the first standby state.

Besides, when the time elapsed from the time the document tray 22 goes into the second standby state to the input of the start signal is extremely long (for example, 5 minutes or more), the document tray 22 may be lowered temporarily to the first standby state. Further, the transition from the first standby state to the second standby state may be performed depending not only on the elapsed time, but also on the operation of any key in the operation section 46 as a trigger.

Note that the judgment of a document size by the first document size detector S0 is performed by a method in which the judgment is made when the manipulation of the document regulating plate 30 is completed, i.e., when there is no change in the output value of the first document size detector S0 for a predetermined time, and measuring of time is started at this time by using the timer function of the controller 41 or the like to measure the above-mentioned first, second and third predetermined times. Therefore, when the document regulating plate 30 is manipulated again during the measurement of time, the timer is reset and time is measured again.

Third Embodiment

The above-described embodiment explains a mode in which the sheet feeder of the present invention is applied to an image reading apparatus, but it is also possible to apply the present invention to an image forming apparatus such as a printer apparatus, and a multi-function apparatus having a scanner function, a printer function, and a facsimile function. The third embodiment illustrates the present invention embodied as an image forming apparatus.

Figure 16:
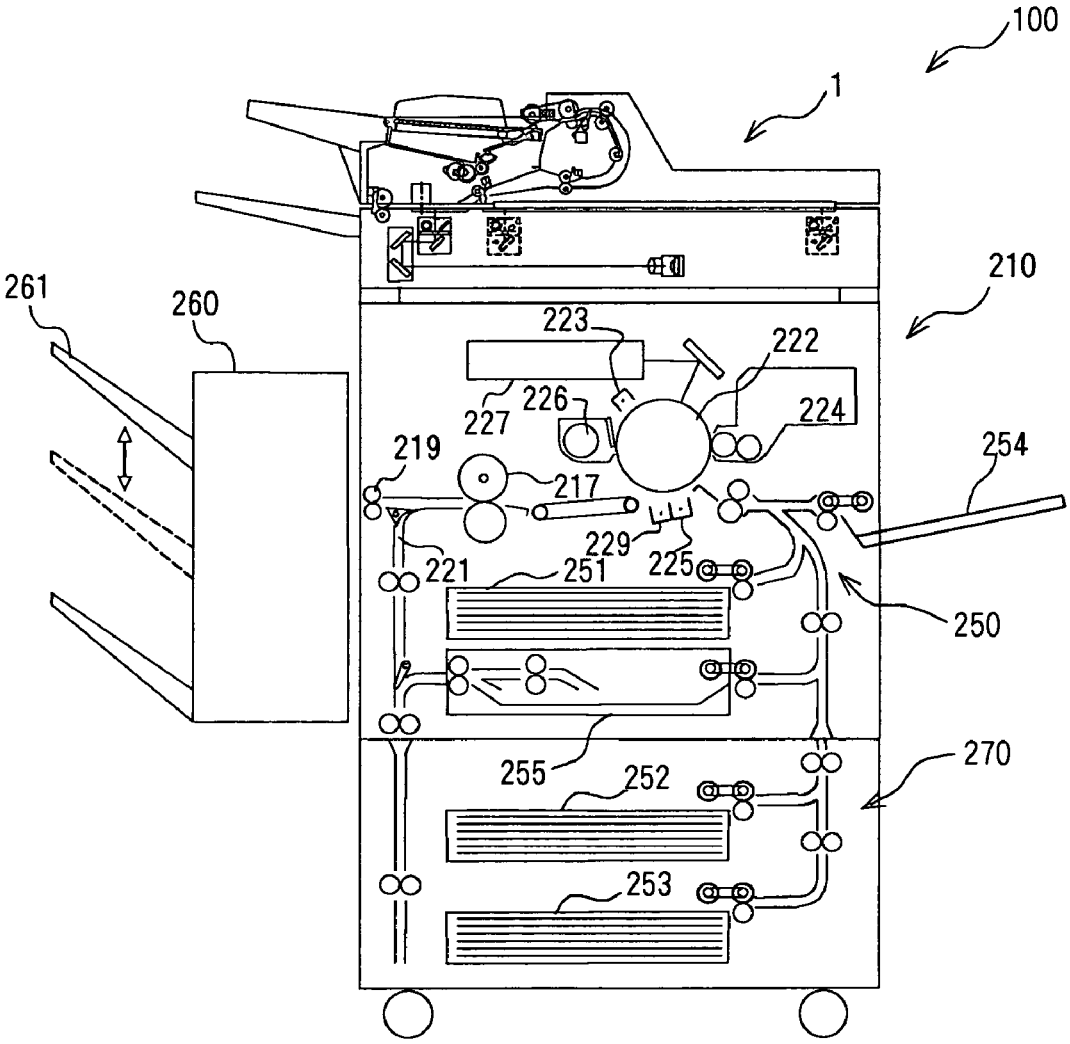
FIG. 16 is a vertical cross sectional view showing the schematic configuration of an image forming apparatus according to an embodiment of the present invention.

FIG. 16 is a vertical cross sectional view showing the schematic configuration of an image forming apparatus according to this embodiment. The image forming apparatus 100 of this embodiment comprises the above-mentioned image reading apparatus 1; an image forming unit 210 for forming images on sheets; a post-treatment unit 260 for performing post-treatment on sheets with images formed thereon; and a sheet feeding unit 270 for supplying and conveying the sheets to the image forming unit 210. The image forming unit 210 is disposed under the image reading apparatus 1, and the post-treatment unit 260 and the sheet feeding unit 270 are respectively mounted on a side section and a lower section of the image forming unit 210.

Note that the image reading apparatus 1 has the function of reading images from documents, and the configuration and operation of the image reading apparatus 1 are the same as those described above, and therefore the explanation thereof is omitted.

The image forming unit 210 has the function of forming an image on a sheet supplied from the sheet feeding unit 270 on the basis of image data obtained by reading the image of a document in the image reading apparatus 1, or image data transferred from an external information processor (not shown).

More specifically, after the image data is transmitted to an image processing section (not shown) and predetermined image processing is performed on the image data, the image data is stored temporarily in an image memory inside the image processing section, and is then read one by one at predetermined timing and transmitted to a laser writing unit 227 that is an optical writing apparatus.

The laser writing unit 227 comprises a semiconductor laser light source for emitting laser light according to the image data transferred from the image memory; a polygon mirror for deflecting the laser light at equal angular velocity; and a f-θ lens for correcting the laser light deflected at equal angular velocity so that the laser light is deflected at equal angular velocity on a photoconductor drum 222.

Note that although this embodiment uses the laser writing unit as the optical writing apparatus, it may be possible to employ a fixed scanning type optical writing head unit using a light emitting element array, such as LED (Light Emitting Diode) and EL (Electro Luminescence).

Disposed around the photoconductor drum 222 are an electrizer 223 for charging the photoconductor drum 222 to an predetermined electric potential; a developing device 224 for changing an electrostatic latent image formed on the photoconductor drum 222 into a visible image by supplying toner to the electrostatic latent image; a transfer device 225 for transferring a toner image formed on the surface of the photoconductor drum 222 to a conveyed sheet; a neutralizer 229 for removing electric charges from the sheet to which the toner image has been transferred and separating the sheet from the photoconductor drum 222; and a cleaning device for collecting the remaining toner after the transfer of the toner image.

The sheet to which the image has been transferred is conveyed to a fixing unit 217, and the image is fixed onto the sheet by the fixing unit 217. The sheet on which the image has been fixed is discharged to the outside by sheet discharge rollers 219.

The post-treatment unit 260 for performing treatment, such as stapling and bending in the middle, on the sheets with images formed thereon is provided on the downstream side of the sheet discharge rollers 219 in the sheet conveying direction, and the sheet guided to the post-treatment unit 260 is discharged onto an elevation/lowering tray 261 after performing predetermined post treatment.

Further, the image forming unit 210 comprises a sheet tray 251, and a manual feed tray 254 for taking in an arbitrary sheet from outside. Then, a sheet supplied from the sheet tray 251 or the manual feed tray 254 is conveyed by sheet conveying means 250 to an image transfer position where the photoconductor drum 222, transfer device 225, etc. are positioned.

In addition, a switchback path 221 used for forming an image again on the rear surface of the sheet is provided on the downstream side of the fixing unit 217 in the sheet conveying direction. The sheet reversed by the switchback path 221 is supplied through a double-side unit 255 to the sheet conveying means 255 again. Note that the switchback path 221 and the double-side unit 255 may be used not only when forming images on both sides of a sheet, but also when reversing the front side and rear side of a sheet before discharging the sheet.

The sheet feeding unit 270 is disposed under the above-mentioned image forming unit 210, comprises a plurality of sheet cassettes 252 and 253 connected to the sheet conveying means 250 of the image forming unit 210, and stores a large amount of sheets of different sizes.

Installed in the image forming apparatus 100 is a controller (not shown) for operating the above-described respective sections in a linked manner to form an image on a sheet supplied from the sheet feeding unit 270 to the image forming unit 210, on the basis of the image of a document read by the image reading apparatus 1.

Note that although the first and second embodiments illustrate modes in which the operation section 46 is installed in the image reading apparatus 1, it is of course possible to provide the operation section 46 in a suitable position of the image forming unit 210.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a sheet storing unit for storing a plurality of sheets layered one upon another;

an elevation/lowering driving unit for elevating/lowering the sheet storing unit;

a sheet conveying unit for taking out sheets one by one from a topmost layer that is brought into contact with the sheet conveying unit by elevating the sheet storing unit with the elevation/lowering driving unit and conveying the sheets to a predetermined conveyance path;

a regulating unit, mounted slidably with respect to the sheet storing unit, for regulating a mount position of sheets;

a position detector for detecting a position of the regulating unit;

a controller capable of controlling an elevation/lowering movement of the sheet storing unit caused by the elevation/lowering driving unit on the basis of a detection result of the position detector;

an image forming unit for forming an image on a sheet conveyed by the sheet conveying unit; and a storing unit for storing standard sized sheet information;

wherein the controller is capable of performing further operations of:

measuring dimensions of a sheet stored in the sheet storing unit on the basis of a detection result of the position detector;

judging whether or not the sheet corresponds to the standard sized sheet information stored in the storing unit, on the basis of the measured dimensions; and controlling the elevation/lowering driving unit to elevate the sheet storing unit when it is judged that the sheet corresponds to the standard sized sheet information.

2. The image forming apparatus according to claim 1, wherein the controller is capable of performing further operations of:

measuring time;

controlling the elevation/lowering driving unit, when it is judged that the sheet corresponds to the standard sized sheet information, to elevate the sheet storing unit after a predetermined time has elapsed from a time at which the judgment was made; and stopping control of the elevation/lowering driving unit when it is judged that the sheet does not correspond to the standard sized sheet information.

3. The image forming apparatus according to claim 1, wherein the controller is capable of performing further operations of:

measuring time;

controlling the elevation/lowering driving unit, when it is judged that the sheet corresponds to the standard sized sheet information, to elevate the sheet storing unit after a first predetermined time has elapsed from a time at which the judgment was made; and controlling the elevation/lowering driving unit, when it is judged that the sheet does not correspond to the standard sized sheet information, to elevate the sheet storing unit after a second predetermined time has elapsed from a time at which the judgment was made.

4. The image forming apparatus according to claim 3, wherein the controller controls the elevation/lowering driving unit, after the second predetermined time has elapsed, to elevate the sheet storing unit to a predetermined position where the topmost layer of the sheets and the sheet conveying unit are separated.

5. The image forming apparatus according to claim 1, further comprising a sheet detector for detecting whether or not a sheet is mounted in the sheet storing unit, wherein the controller is capable of performing further operations of:

controlling the elevation/lowering driving unit, when the sheet detector detects a sheet stored in the sheet storing unit and it is judged that the sheet corresponds to the standard sized sheet information, to elevate the sheet storing unit after a predetermined time has elapsed; and stopping control of the elevation/lowering driving unit when the sheet detector detects a sheet stored in the sheet storing unit and it is judged that the sheet does not correspond to the standard sized sheet information.

6. The image forming apparatus according to claim 5, wherein the controller controls the elevation/lowering driving unit, after a second predetermined time has elapsed, to elevate the sheet storing unit to a predetermined position where the topmost layer of the sheets and the sheet conveying unit are separated.

7. The image forming apparatus according to claim 1, further comprising a sheet detector for detecting whether or not a sheet is mounted in the sheet storing unit, wherein the controller is capable of performing further operations of:

controlling the elevation/lowering driving unit, when the sheet detector detects a sheet stored in the sheet storing unit and it is judged that the sheet corresponds to the standard sized sheet information, to elevate the sheet storing unit after a first predetermined time has elapsed; and controlling the elevation/lowering driving unit, when the sheet detector detects a sheet stored in the sheet storing unit and it is judged that the sheet does not correspond to the standard sized sheet information, to elevate the sheet storing unit after a second predetermined time has elapsed.

8. The image forming apparatus according to claim 7, wherein the controller controls the elevation/lowering driving unit, after the second predetermined time has elapsed, to elevate the sheet storing unit to a predetermined position where the topmost layer of the sheets and the sheet conveying unit are separated.

9. The image forming apparatus according to claim 1, further comprising a contact detector for detecting a contact state between the topmost layer of the sheets stored in the sheet storing unit and the sheet conveying unit, wherein the controller controls the elevation/lowering driving unit to elevate the sheet storing unit until the contact detector detects the contact state.

10. An image forming apparatus comprising:

sheet storing means for storing a plurality of sheets layered one upon another;

elevation/lowering driving means for elevating/lowering the sheet storing means;

sheet conveying means for taking out sheets one by one from a topmost layer that is brought into contact with the sheet conveying means by elevating the sheet storing means with the elevation/lowering driving means and conveying the sheets to a predetermined conveyance path;

regulating means, mounted slidably with respect to the sheet storing means, for regulating a mount position of sheets;

position detecting means for detecting a position of the regulating means;

control means for controlling an elevation/lowering movement of the sheet storing means caused by the elevation/lowering driving means on the basis of a detection result of the position detecting means;

image forming means for forming an image on a sheet conveyed by the sheet conveying means;

storing means for storing sheet information standard sized sheet information;

measuring means for measuring dimensions of a sheet stored in the sheet storing means on the basis of a detection result of the position detecting means; and judging means for judging whether or not the sheet corresponds to the sheet information standard sized sheet information stored in the storing means, on the basis of the dimensions measured by the measuring means, wherein, when the judging means judges that the sheet corresponds to the sheet information standard sized sheet information, the control means controls the elevation/lowering driving means to elevate the sheet storing means.

11. The image forming apparatus according to claim 10, further comprising timer means, wherein, when the judging means judges that the sheet corresponds to the standard sized sheet information, the control means controls the elevation/lowering driving means to elevate the sheet storing means after a predetermined time has elapsed from a time at which the judging means made the judgment; and when the judging means judges that the sheet does not correspond to the standard sized sheet information, the control means stops control of the elevation/lowering driving means.

12. The image forming apparatus according to claim 10, further comprising timer means, wherein, when the judging means judges that the sheet corresponds to the standard sized sheet information, the control means controls the elevation/lowering driving means to elevate the sheet storing means after a first predetermined time has elapsed from a time at which the judging means made the judgment; and when the judging means judges that the sheet does not correspond to the standard sized sheet information, the control means controls the elevation/lowering driving means to elevate the sheet storing means after a second predetermined time has elapsed from a time at which the judging means made the judgment.

13. The image forming apparatus according to claim 12, wherein the control means controls the elevation/lowering driving means, after the second predetermined time has elapsed, to elevate the sheet storing means to a predetermined position where the topmost layer of the sheets and the sheet conveying means are separated.

14. The image forming apparatus according to claim 10, further comprising sheet detecting means for detecting whether or not a sheet is mounted in the sheet storing means, wherein, when the sheet detecting means detects a sheet stored in the sheet storing means and the judging means judges that the sheet corresponds to the standard sized sheet information, the control means controls the elevation/lowering driving means to elevate the sheet storing means after a predetermined time has elapsed; and when the sheet detecting means detects a sheet stored in the sheet storing means and the judging means judges that the sheet does not correspond to the standard sized sheet information, the control means stops control of the elevation/lowering driving means.

15. The image forming apparatus according to claim 14, wherein the control means controls the elevation/lowering driving means, after a second predetermined time has elapsed, to elevate the sheet storing means to a predetermined position where the topmost layer of the sheets and the sheet conveying means are separated.

16. The image forming apparatus according to claim 10, further comprising sheet detecting means for detecting whether or not a sheet is mounted in the sheet storing means, wherein, when the sheet detecting means detects a sheet stored in the sheet storing means and the judging means judges that the sheet corresponds to the standard sized sheet information, the control means controls the elevation/lowering driving means to elevate the sheet storing means after a first predetermined time has elapsed; and when the sheet detecting means detects a sheet stored in the sheet storing means and the judging means judges that the sheet does not correspond to the standard sized sheet information, the control means controls the elevation/lowering driving means to elevate the sheet storing means after a second predetermined time has elapsed.

17. The image forming apparatus according to claim 16, wherein the control means controls the elevation/lowering driving means, after the second predetermined time has elapsed, to elevate the sheet storing means to a predetermined position where the topmost layer of the sheets and the sheet conveying means are separated.

18. The image forming apparatus according to claim 10, further comprising contact detecting means for detecting a contact state between the topmost layer of the sheets stored in the sheet storing means and the sheet conveying means, wherein the control means controls the elevation/lowering driving means to elevate the sheet storing means until the contact detecting means detects the contact state.

* * * * *